US007802454B2

(12) United States Patent
Cho et al.

(10) Patent No.: US 7,802,454 B2
(45) Date of Patent: Sep. 28, 2010

(54) WASHING MACHINE

(75) Inventors: Ki Chul Cho, Changwon-si (KR); Soung Bong Choi, Changwon-si (KR); Myong Dok Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/289,275

(22) Filed: Oct. 23, 2008

(65) Prior Publication Data

US 2009/0120137 A1 May 14, 2009

Related U.S. Application Data

(62) Division of application No. 10/512,876, filed on Oct. 29, 2004, now Pat. No. 7,454,929.

(30) Foreign Application Priority Data

Feb. 6, 2003 (KR) ..... 10-2003-0007345
Feb. 6, 2003 (KR) ..... 10-2003-0007346
Feb. 6, 2003 (KR) ..... 10-2003-0007350
Feb. 6, 2003 (KR) ..... 10-2003-0007365
Feb. 6, 2003 (KR) ..... 10-2003-0007366

(51) Int. Cl.
*D06F 39/00* (2006.01)

(52) U.S. Cl. ..... 68/12.24; 68/12.01

(58) Field of Classification Search ..... 68/12.01, 68/12.24

See application file for complete search history.

(56) References Cited

U.S. PATENT DOCUMENTS 4,317,343 A 3/1982 Gerry
5,152,159 A 10/1992 Kabeya et al.
5,892,307 A * 4/1999 Pavlovich et al. ..... 310/68 B
6,006,553 A 12/1999 Lee et al.
6,202,451 B1 3/2001 Park et al.
6,332,343 B1 * 12/2001 Koketsu et al. ..... 68/23.7
6,396,177 B1 5/2002 Shin et al.
6,496,177 B1 5/2002 Shin et al.
7,385,322 B2 * 6/2008 Park ..... 310/61
2002/0170119 A1 11/2002 Park et al.
2003/0006665 A1 * 1/2003 Kim et al. ..... 310/231
2003/0131636 A1 7/2003 Lim et al.

FOREIGN PATENT DOCUMENTS

CN 1269437 A 10/2000

(Continued)

*Primary Examiner*—Michael Barr
*Assistant Examiner*—Jason Heckert
(74) *Attorney, Agent, or Firm*—McKenna Long & Aldridge LLP

(57) ABSTRACT

Washing machine including an outer tub in a cabinet for holding washing water, an inner tub rotatably mounted on an inside of the outer tub having an agitating device rotatably mounted therein, a power transmission device having a washing shaft connected to the agitating device and a spinning shaft connected to the inner tub, a driving motor on an outside of the outer tub having a rotor assembly with a magnetism, and a hollow stator assembly arranged in the rotor, a clutch assembly for selective transmission of a driving power from the driving motor to the spinning shaft depending on operation modes, and a drain device for draining the washing water to an outside of the washing machine.

11 Claims, 18 Drawing Sheets

FOREIGN PATENT DOCUMENTS

| | | |
|---|---|---|
| JP | 2000-102694 | 4/2000 |
| JP | 2000-279692 | 10/2000 |
| JP | 2000-279692 A | 10/2000 |
| JP | 2002-028396 | 1/2002 |
| JP | 2003-010587 | 1/2003 |
| KR | 1999-0084883 | 12/1999 |
| KR | 10-0315807 | 12/2001 |

* cited by examiner

WASHING MACHINE

This application is a divisional of application Ser. No. 10/512,876, filed Oct. 29, 2004 now U.S. Pat. No. 7,454,929, and claims the benefit of Korean Patent Application No. 10-2003-0007346, Korean Patent Application No. 10-2003-0007366, Korean Patent Application No. 10-2003-0007345, Korean Patent Application No. 10-2003-0007350, and Korean Patent Application No. 10-2003-0007365 all filed on Feb. 6, 2003, each of which are hereby incorporated by reference for all purposes as if fully set forth herein.

TECHNICAL FIELD

The present invention relates to washing machines, and more particularly, to a washing machine in which structures of a driving motor, a device for transmitting power from the driving motor to a pulsator and an inner tub, and a clutch assembly, are improved.

BACKGROUND ART

The washing machine progresses washing, rinsing, and spinning cycles to remove contaminants stuck to clothes by using actions of detergent, and water. FIG. 1 illustrates a section of a typical pulsator type washing machine, which will be described.

Referring to FIG. 1, there is an outer tub 20 in a cabinet 10 which forms an outside shape in a floated state by dampers 15, for holding water, and an inner tub 30 rotatably mounted on an inside of the outer tub 20. The inner tub 30 has a plurality of pass through holes (not shown), so that the water supplied to the inner tub 30 or the outer tub 20 flows between the inner tub 30 and the outer tub 20. There is a pulsator 35 rotatably mounted on a central part of a bottom of the inner tub 30. In the meantime, the outer tub 20 has a drain hose 60 in communication with an outside of the cabinet 10 connected thereto, with a drain valve 65 on a middle of the hose 60.

The inner tub 30 has a washing shaft 41 connected thereto, and the pulsator 35 has the washing shaft 41 connected thereto through a spinning shaft 45 and the inner tub 30. The washing shaft 41 and the spinning shaft 45 are connected with a clutch assembly 40, mechanically. In the meantime, there is a motor 50 under the outer tub 20 spaced a distance from the clutch assembly 40 for generating power, and a belt 55 connects the motor 50 and a lower end of the washing shaft 41.

In the foregoing typical pulsator type washing machine, when the motor 50 is put into operation, the rotation power is transmitted to the washing shaft 41 through the belt 55.

In this case, if it is in a state the clutch assembly 40 separates the washing shaft 41 from the spinning shaft 45, only the pulsator 35 rotates. Accordingly, the washing machine can carries out washing or rinsing by using water circulation and friction force generated by rotation of the pulsator 35.

Opposite to this, if it is in a state the clutch assembly 40 connects the washing shaft 41 and the spinning shaft 45, the pulsator rotates 35, together with the inner tub 30. According to this, the washing machine can carry out spinning for extract moisture from the laundry. Of course, in this time, the drain valve 65 is opened to drain water from the outer tub 20 to an outside of the washing machine through the drain hose 60.

However, the typical washing machine has the following a few problems.

At first, as described, the typical washing machine has a structure in which rotating power is transmitted from the motor to the washing shaft by a belt, indirectly. Therefore, power transmission loss caused by belt slip, and friction is very high.

Moreover, in the typical washing machine, for preventing slip during the power transmission, the belt is set to pull a lower end part of the washing shaft with high tension. And, the heavy motor is mounted under the outer tube on one side thereof away from a center part. Therefore, the inner tub, and the outer tub can be tilted within the cabinet.

DISCLOSURE OF INVENTION

An object of the present invention designed for solving the foregoing problems lies on minimizing a power transmission loss caused when driving power is transmitted from a motor to a washing shaft.

Other object of the present invention lies on improving a stricture in which an inner tub and an outer tub of a washing machine are not tilted even if the washing machine is used for a long time in a state a motor and a power transmission device are mounted thereon.

Another object of the present invention lies on reducing a height of the washing machine for convenience of user.

Further object of the present invention lies on improving a structure of a motor for providing interchangeability of parts of motors of different outputs applicable to washing machines of different capacities.

Still further object of the present invention lies on improving a stricture of a washing machine motor such that heat generated at the motor during operation of a washing machine can be dispersed, effectively.

In order to achieve the objects of the present invention, there is provided a washing machine including an outer tub in a cabinet for holding washing water, an inner tub rotatably mounted on an inside of the outer tub having an agitating device rotatably mounted therein, a power transmission device having a washing shaft connected to the agitating device and a spinning shaft connected to the inner tub, a driving motor on an outside of the outer tub having a rotor assembly with a magnetism, and a hollow stator assembly arranged in the rotor, a clutch assembly for selective transmission of a driving power from the driving motor to the spinning shaft depending on operation modes, and a drain device for draining the washing water to an outside of the washing machine.

The rotor assembly includes a rotor frame having the washing shaft connected to a lower central part directly, and a plurality of permanent magnets attached to an inside circumferential surface of the rotor frame. It is preferable that the rotor frame includes serration projected from one surface for selective engagement with the spinning shaft, and steps provided along an inside circumferential surface for supporting lower ends of the permanent magnets.

The rotor frame includes a plurality of curved incisions provided along the outside circumference of the rotor frame. The rotor frame includes ribs each formed by projecting a part of the rotor assembly adjoining the incision to an inside of the rotor assembly for supporting the lower end of the permanent magnet. It is preferable that incisions are arranged between a top end and the steps along the outside circumferential surface of the rotor frame.

The rotor frame includes at least one cooling blade formed by a curved incising of a part of an outside circumferential surface of the rotor frame, and bending toward an inside of the rotor frame. It is preferable that some of the cooling blades are incised and bent in a rotation direction of the rotor frame, and rest of the cooling blades are incised and bent in an opposite direction of rotation of the rotor frame. It is preferable that a number of the incised and bent cooling blades in a direction of rotation of the rotor frame in spinning is greater than a number of the incised and bent blades in a direction opposite to the rotation direction of the rotor frame.

The power transmission device includes a washing shaft having an upper washing shaft connected to the agitating device, and a lower washing shaft directly connected to the rotor assembly, a spinning shaft having an tipper spinning shaft connected to the inner tub, and a lower spinning shaft spaced a distance away from the rotor assembly, and a gear device connected between the upper, and lower washing shafts, and the upper, and lower spinning shafts.

The gear device includes a sun gear connected to the lower washing shaft, a plurality of planet gears engaged with an outside circumferential surface of the sun gear, a carrier connected between the planet gears and the upper washing shaft, and a drum having an inside circumferential surface engaged with the planet gears, and connected to the upper, and lower washing shaft.

The clutch assembly includes a clutching coupler mounted movable along a length direction of the spinning shaft for selectively coupling the spinning shaft and the rotor assembly, and an elevating device for moving up/down the clutching coupler. The elevating device includes a clutch lever having one end engaged with the clutching coupler, and an intermediate point connected to a hinge shaft, and a clutch motor for pulling or pushing the other end of the clutch lever for moving up/down one end of the clutch lever.

The clutch assembly may further include a stopper over the clutching coupler for limiting a moving up distance of the clutching coupler. It is preferable that either the stopper or the clutching coupler includes recesses or projections to be inserted in the recesses for prevention of rotation of the clutching coupler and the spinning shaft when the clutching coupler is in contact with the stopper.

The clutch assembly preferably includes a brake assembly for intermitting rotation of the spinning shaft. The brake assembly includes a brake pad arranged to contact with, or adjacent to, the drum directly connected to the spinning shaft in the power transmission device, a brake lever having one end connected to the brake pad, and an intermediate one point connected to a hinge shaft, and an operation motor for pulling or pushing the other end of the brake lever, for braking, or releasing the braking on the drum.

The drain device includes a drain passage for making an outside of the cabinet in communication with the outer tub, a drain valve for opening/closing the drain passage, and an operation motor for pulling or pushing the drain valve to open close the drain passage.

It is preferable that the brake assembly and the drain device are operative by the same operation motor. In this case, it is preferable that the operation motor is operative in a first step mode for intermitting rotation of the spinning shaft, and a second step mode for releasing the braking on the spinning shaft, and at the same time, draining the washing water.

In the first step mode, it is preferable that the brake pad releases the braking on the drum, and the drain valve closes the drain passage. It is preferable that, in the second step mode, the brake pad releases the braking on the drum, and the drain valve opens the drain passage.

For controlling the brake assembly and the drain device with single operation motor, it is preferable that the drain valve includes a packing for closing the drain passage, a second rod connected to the packing, and a first rod connected to the drain lever for moving a first distance alone to move the brake lever to brake the drum when the operation motor is operative in the first step mode, and moving together with the second rod up to a second length to open the drain passage when the operation motor is operative in the second step mode.

In the meantime, the operation mode includes at least one of a first mode for rotating the agitating device only, a second mode for rotating the agitating device and the inner tub in the same direction, and a third mode for rotating the agitating device and the inner tub in opposite directions.

In the first mode, the clutch assembly disengages the lower spinning shaft from the rotor assembly, and brakes the drum. Then, only the agitating device rotates to carry out washing or rinsing. Meanwhile, in the first mode, it is preferable that the clutching coupler disengaged from the rotor assembly makes close contact with the stopper that limits a moving distance of the clutching coupler.

In the second mode, the clutch assembly engages the lower spinning shaft with the rotor assembly, and releases the braking on the drum. Then, the agitating device and the inner tub rotate in the same direction, to carry out washing, rinsing, or spinning.

In the case of the second mode, the agitating device and the inner tub rotate at a high speed so that the washing water between the inner tub and an outer tub rises toward an upper part of the outer tub by a centrifugal force, and falls down to an inside of the inner tub, or the agitating device and the inner tub rotate at a low speed so that the washing water between the inner tub and an outer tub maintains a state in which washing water is attached to an inside wall of the outer tub by a centrifugal force.

In the second mode when spinning is carried out, the drain device drains the washing water to an outside of the washing machine.

In the meantime, in the third mode, the clutch assembly disengages the lower spinning shaft from the rotor assembly, and releases the braking on the drum. Then, the agitating device and the inner tub rotate in opposite directions at the same time, to carry out washing, or rinsing.

In the third mode, it is preferable that the clutching coupler of the clutch assembly disengaged from the rotor assembly is arranged at a position spaced a predetermined distance from the stopper that limits a moving distance of the clutching coupler, for an example, 1.about.10 mm. This is for preventing the clutching coupler hitting the stopper when the spinning shaft rotates, to prevent wear and generation of noise.

In the meantime, above structure enables transmission of power from the driving motor to the agitating device and the inner tub without loss. Despite of the direction connection of the power transmission device to the driving motor, an increase of a height of the washing machine prevented, which is convenient to use. Moreover, cooling performance of the driving motor is improved, and components are interchangeable in fabrication of motors with different outputs. Since the clutch assembly and the drain device have simple structures and operative accurately, product reliability becomes higher. Since directions and speeds of the agitating means and the inner tub are variable and easily controllable, a high washing performance is obtainable.

BRIEF DESCRIPTION OF DRAWINGS

The accompanying drawings, which are included to provide a further understanding of the invention, illustrate embodiments of the invention and together with the description serve to explain the principle of the invention.

In the drawings;

FIGS. 8A.about.8C illustrate diagrams showing configurations of various parts when only a pulsator rotates in the washing machine in FIG. 2 respectively, wherein FIG. 8A illustrates a perspective view showing positions of a clutch lever, a sliding coupler, and a stopper in a clutch assembly.

FIGS. 9A.about.9C illustrate diagrams showing configurations of various parts when a pulsator and an inner tub rotate in the same direction in the washing machine in FIG. 2 respectively, wherein FIG. 9A illustrates a perspective view showing positions of a clutch lever, a sliding coupler, and a stopper in a clutch assembly, FIGS. 10A.about.10C illustrate diagrams showing configurations of various parts when a pulsator and an inner tub rotate in opposite directions in the washing machine in FIG. 2 respectively, wherein FIG. 10A illustrates a perspective view showing positions of a clutch lever, a sliding coupler, and a stopper in a clutch assembly.

BEST MODE FOR CARRYING OUT THE INVENTION

Reference will now be made in detail to the preferred embodiments of the present invention, examples of which are illustrated in the accompanying drawings.

In describing the embodiments, same parts will be given the same names and reference symbols, and additional, and repetitive description of which will be omitted.

Figure 1:
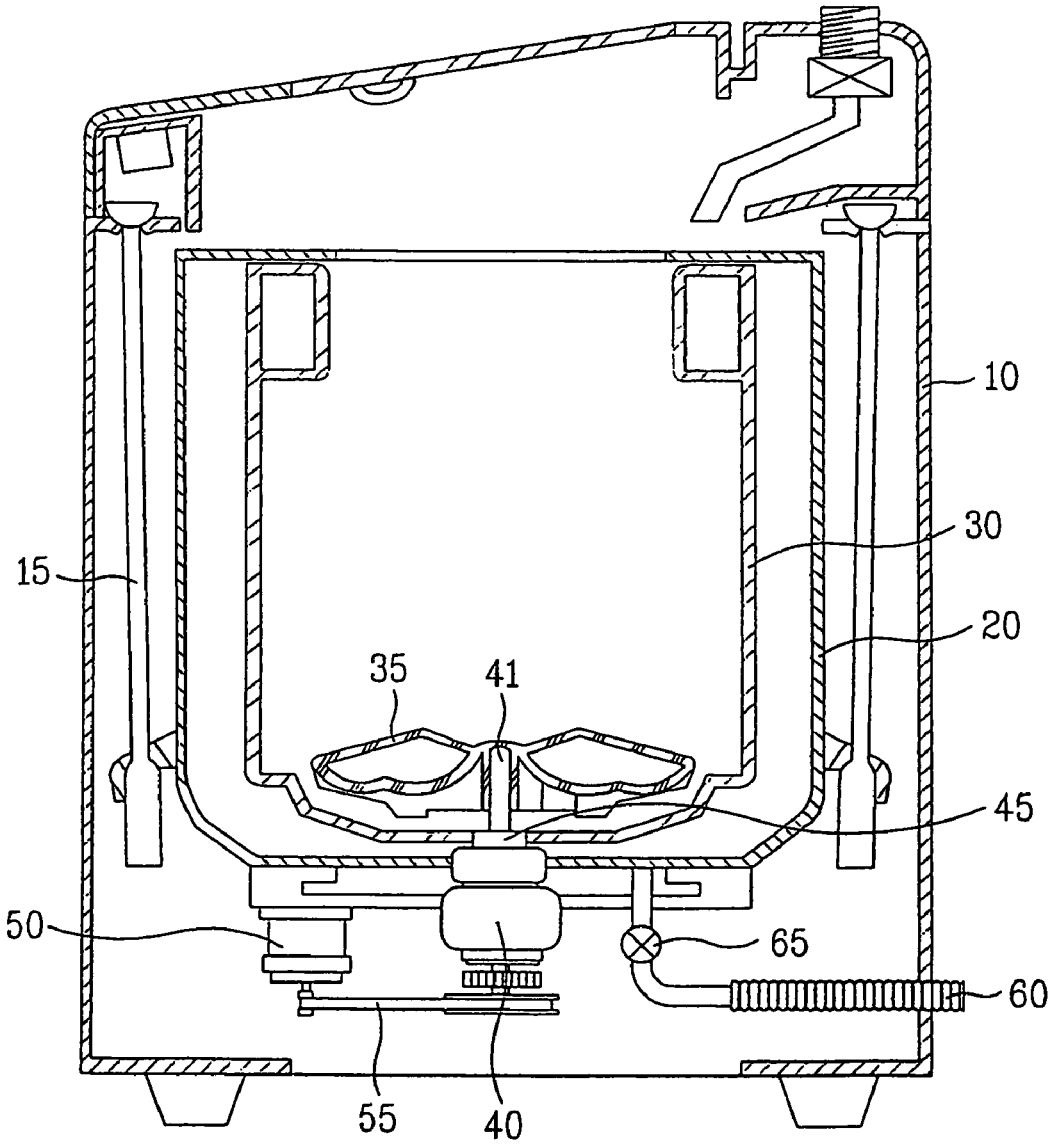
FIG. 1 illustrates a section of a typical washing machine.
Figure 2:
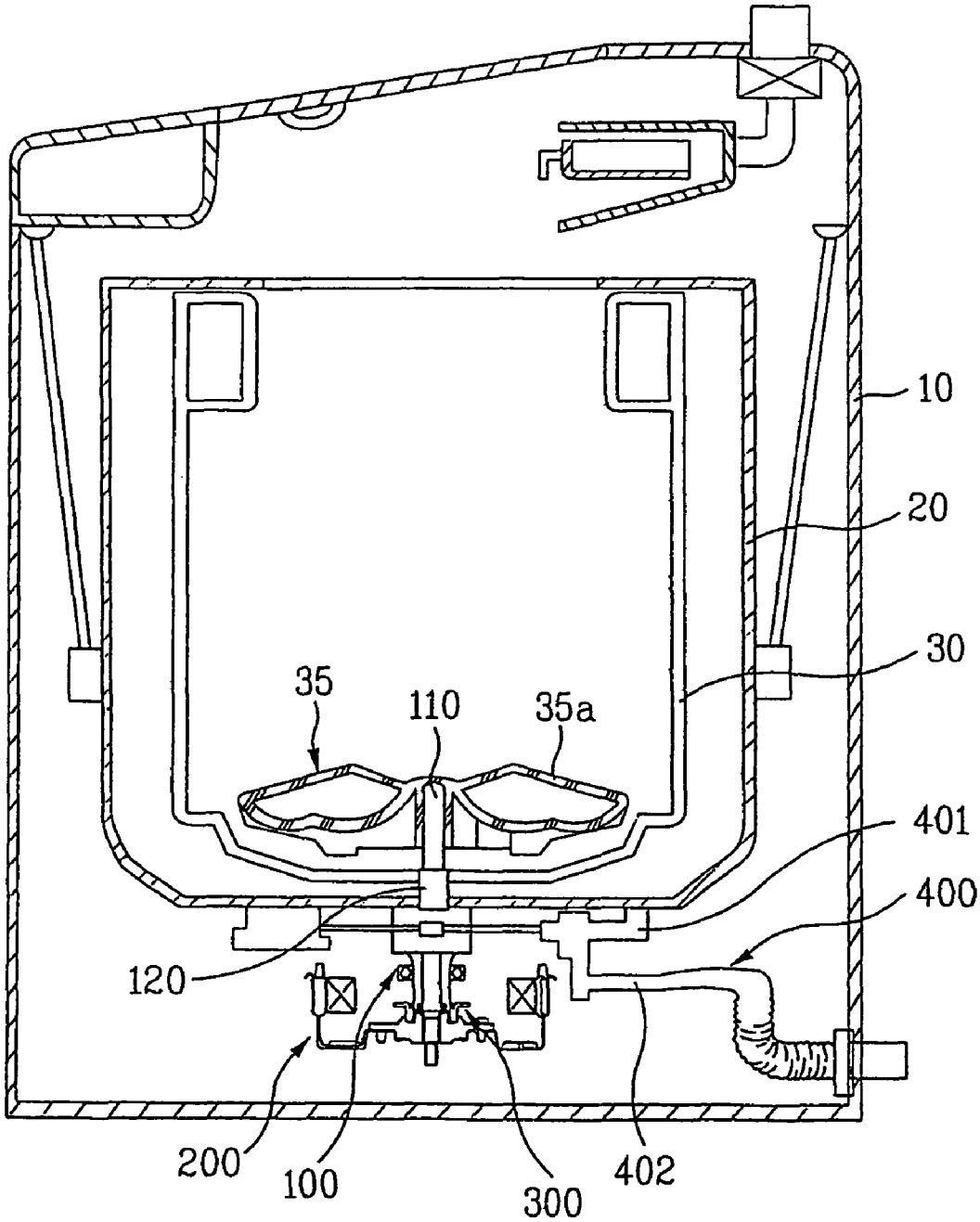
FIG. 2 illustrates a section of a washing machine in accordance with a preferred embodiment of the present invention.

Referring to FIG. 2, there are an outer tub 20 in a cabinet 10 for holding washing water, and an inner tub 30 rotatably mounted on an inside of the outer tub 20, having a plurality of pass through holes (not shown) in an outside circumference. There is an agitator rotatably mounted on an inside of the inner tub 30 for causing a water circulation.

Referring to FIG. 2, the agitator may be a pulsator 35 having at least one washing blades 35*a* projected outward, the agitator is not limited to this. That is, through not shown, the agitator may be a pole stick out inside of the inner tub 30. In this case, it is preferable that the pole has at least one washing blade on an outside circumferential surface of the pole. Therefore, a structure of the agitator is not limited to one shown in FIG. 2, but the structure is adequate as far as the structure can cause the water circulation while the structure rotates inside of the inner tub 30.

In the meantime, referring to FIG. 2, the washing machine of the present invention has a power transmission device directly connected to a driving motor. However, in the direct connection of the power transmission device to the driving motor, if a related art inner rotor type induction motor is mounted on a lower end of a related art power transmission device, a height of the washing machine can not but become higher as much as a height of the rotor.

Meanwhile, in general, since the washing machine with the pulsator has an opening in a top side, introduction into, and taking out laundry from, the washing machine through the opening are not convenient, if the height of the washing machine becomes higher. Therefore, a washing machine of a height a user can use with convenience can be provided only if a technical problem caused by the direction connection of the power transmission device and the driving motor is solved.

Accordingly, referring to FIG. 2, the present invention employs an outer rotor type motor, particularly, a brushless DC motor (BLDC motor) instead of the related art inner rotor type motor as the driving motor 200. As shown in FIG. 2, if the BLDC motor is employed as the driving motor 200 thus, and the power transmission device 100 and the driving motor 200 are connected directly, the washing machine is not required to increase a height because the power transmission device 100 is connected to a bottom part of the driving motor 200.

In the meantime, in the present invention having the driving motor 200 and the power transmission device 100 connected directly, a structure of a clutch assembly 300 for intermitting power transmission from the driving motor 200 to the inner tub 30 selectively is also very simple. Moreover, some components of a drain device 400 for draining the washing water from the outer tub 20, and the clutch assembly 300 are designed to have a close relation with each other such that the drain device 400 and the clutch assembly 300 can be driven with one motor.

Different parts of the washing machine of the present invention having the foregoing structural advantages, such as the power transmission device 100, the driving motor 200, the clutch assembly 300, and the drain device 400, will be described with reference to the attached drawings.

Figure 3:
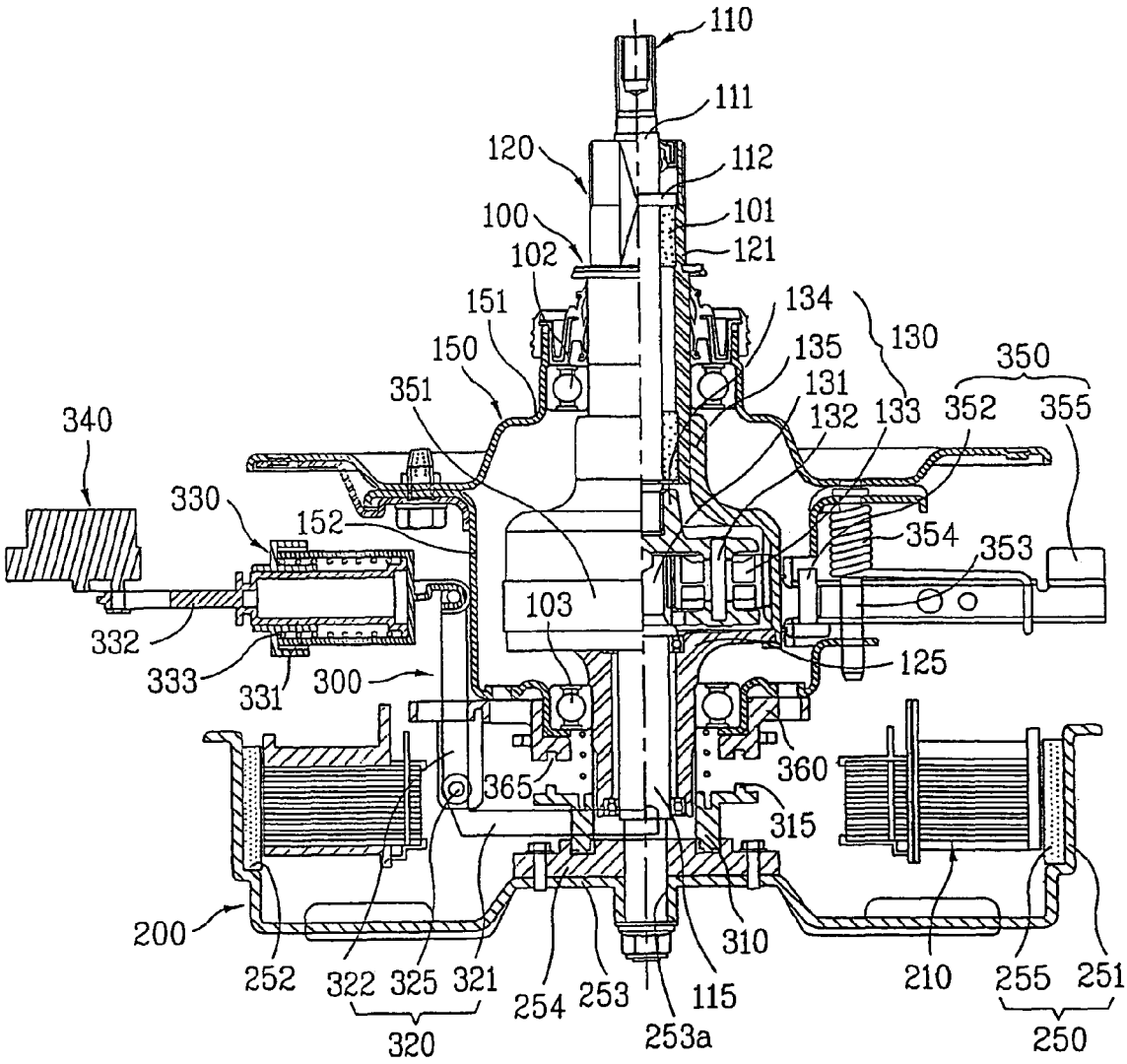
FIG. 3 illustrates a partial section of a motor, a power transmission device, and a clutch assembly of the washing machine in FIG. 2.

The power transmission device 100 includes a washing shaft 110 mounted to pass through the outer tub 20 and the inner tub 30, and connected to the agitating device, and a spinning shaft 120 connected to the inner tub 30. The washing shaft 110 is connected to the agitating device, and the spinning shaft 120 is connected to the inner tub 30. As shown in FIG. 3, the washing shaft 110 is mounted inside of the spinning shaft 120 to pass through the spinning shaft 120, which are closely connected with a gear device 130. The washing shaft 110, the spinning shaft 120, and the gear device 130 will be described in more detail, hereafter.

Referring to FIG. 3, the washing shaft 110 has an upper washing shaft 111 and a lower washing shaft. A top end of the upper washing shaft is connected to the agitating device, and a bottom end of the lower washing shaft 115 is connected to the driving motor 200, more specifically, a shaft of a rotor assembly 250 of the driving motor 200.

The spinning shaft 120 also has an upper spinning shaft 121 and a lower spinning shaft 125. A top end of the upper spinning shaft 121 is connected to the inner tub 30, and a lower end of the lower spinning shaft 125 is arranged spaced a distance away from the driving motor 200, more specifically, the rotor assembly 250 of the driving motor 200.

Since the washing shaft 110 is mounted in the spinning shaft 120, there is a bearing inserted between the washing shaft 110 and the spinning shaft 120 for making the washing shaft 110 to rotate in a state the washing shaft 110 is upright, correctly. As shown in FIG. 3, in the washing machine of the present invention, there is an oiless bearing 101 between the washing shaft 110 and the spinning shaft 120, particularly, between the upper washing shaft 111 and the upper spinning shaft 121.

The oiless bearing has a nature in which, when heat is generated by friction, oil is fed from an inside thereof to a friction part in an outside part. Therefore, if heat is generated, as the upper washing shaft 111 rotates to cause friction with the upper spinning shaft 121, since oil soaks out of the oiless bearing 101, to lubricate the friction part, the washing shaft 110 can rotate, smoothly.

In order to prevent the washing shaft 110 mounted to pass through an inside of the spinning shaft 120 from falling out downward, the washing shaft 110, more specifically, the upper washing shaft 111 has an extended part 112 projected from an outside circumferential surface thereof, seated on a top of the oiless bearing 101.

Figure 8:
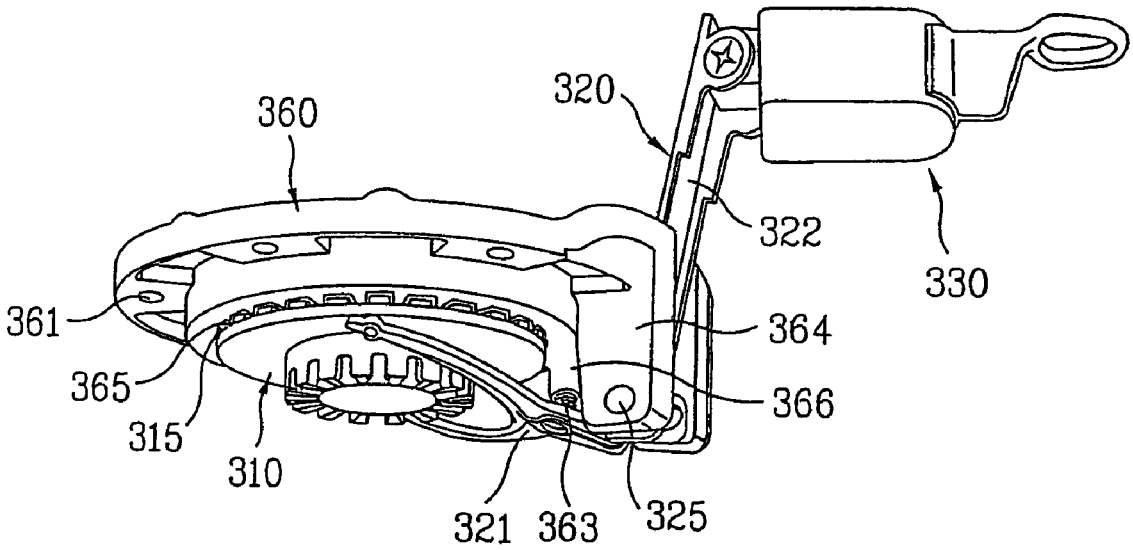

In the meantime, the upper washing shaft 111, the lower washing shaft 115, the upper spinning shaft 121, and the lower spinning shaft 125 are coupled with the gear device 130. As shown in FIGS. 3 and 8C, the gear device 130 includes a planetary gear device having a sun gear, planet gears 133, a carrier 134, and a drum 135.

The sun gear 131 is connected to a top end of the lower washing shaft 115. The plurality of planet gears 133 are engaged with an outside circumference of the sun gear 131. The carrier, connecting shafts 132 of the planet gears 133, has a top end connected to a bottom end of the upper washing shaft 111. Lastly, the drum 135 has an inside circumferential surface engaged with the planet gears 133, and a top end and a bottom end connected to the upper spinning shaft 121 and the lower spinning shaft 125 respectively.

A process for the power transmission device 100 transmitting driving power from the motor 200 to the agitating device and the inner tub 30 will be described.

The driving motor 200, more specifically, the rotor assembly 250, is directly connected to the lower washing shaft 115. Therefore, when the driving motor 200 is operated to rotate the rotor assembly 250, the lower washing shaft 115 rotates.

In this instance, if it is assumed that the lower washing shaft 115 rotates in a clockwise direction while the drum 135 is held so as not to rotate the spinning shaft 120, the sun gear 131 rotates in a clockwise direction, and the planet gears 133 engaged with the sun gear 131 rotate in a counter clockwise direction as well as revolve around the sun gear 131 in the clockwise direction (see FIG. 8C).

Consequently, the carrier 134 connected to the shafts 132 of the planet gears 133 rotates in a clockwise direction, to rotate the upper washing shaft 111 and the agitating device in the clockwise direction, accordingly.

Figure 9A:
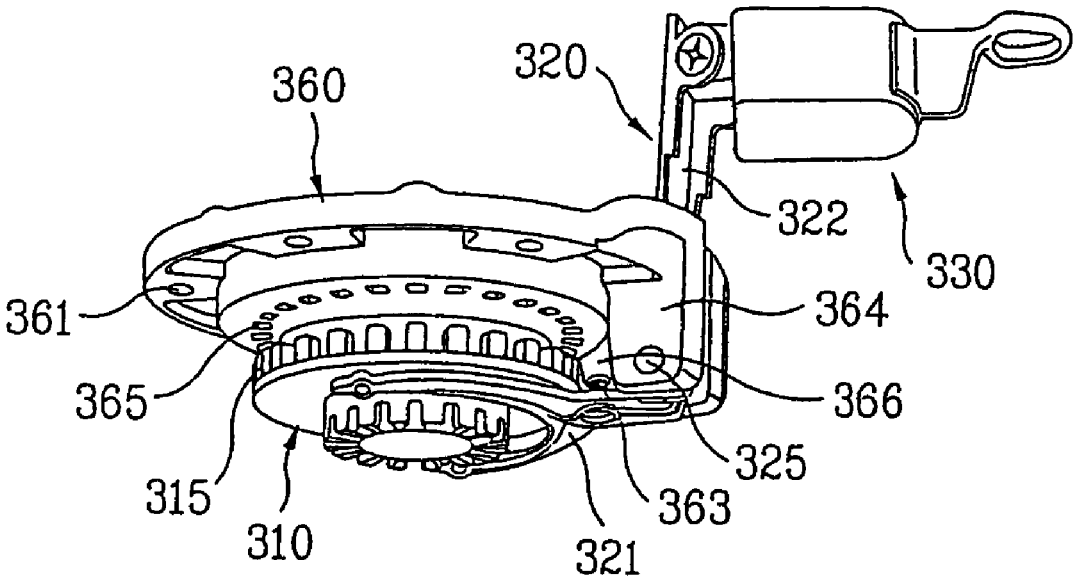
Figure 9B:
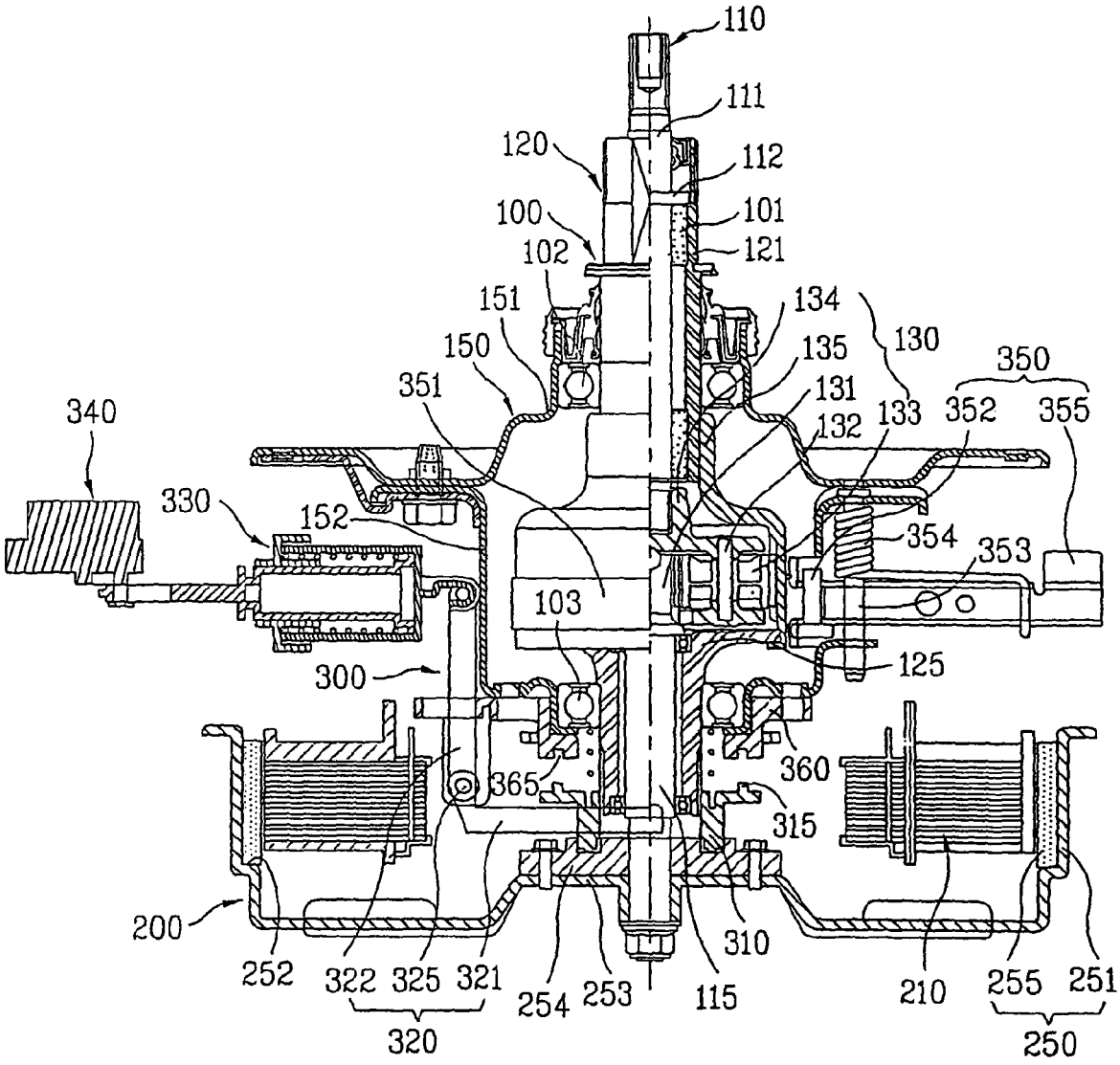
FIG. 9B illustrates a partial section showing positions of a motor, a power transmission device, and a clutch assembly.
Figure 9C:
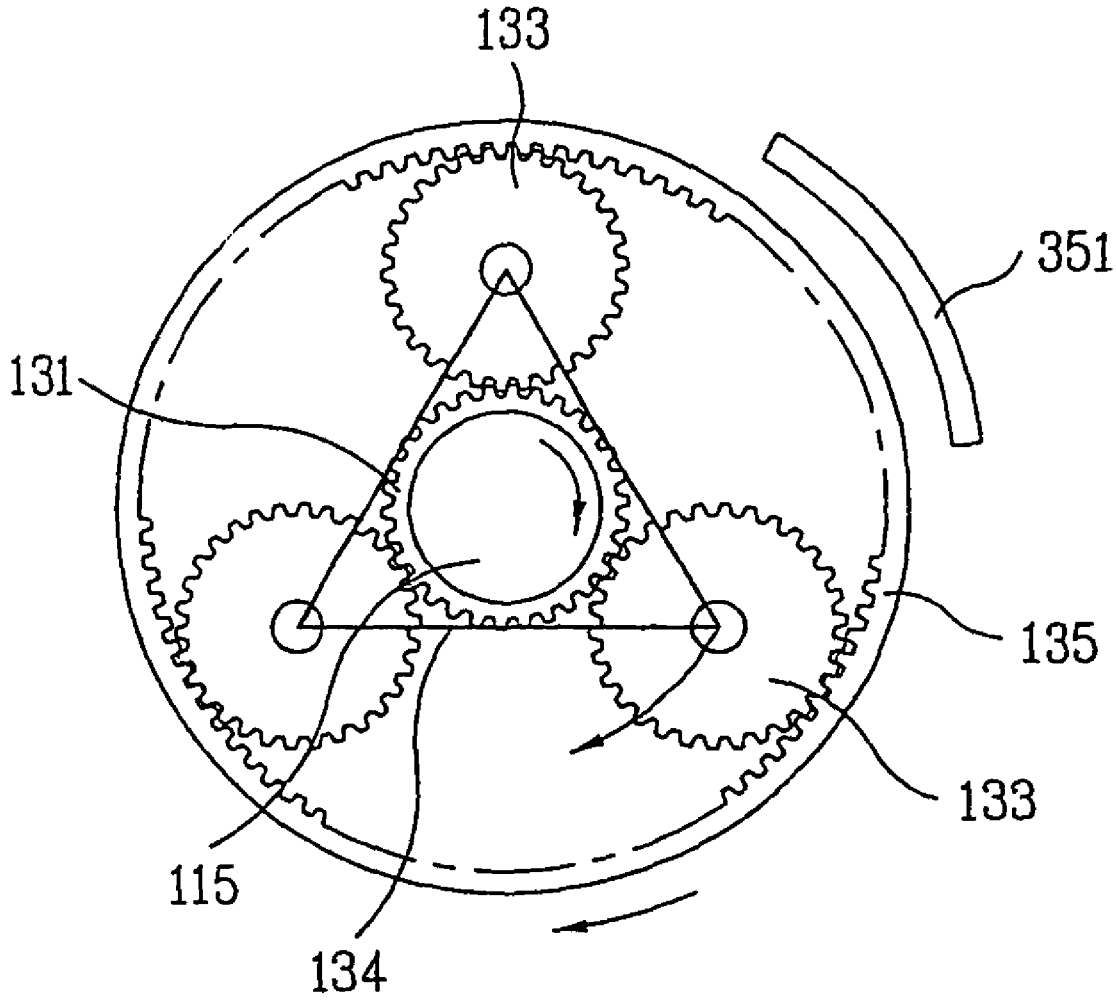
FIG. 9C illustrates a section showing a relation between gears and a brake pad in the power transmission device in FIG. 9B.

Next, a case will be reviewed, in which the lower spinning shaft 125 is connected to the rotor assembly 250, and the braking on the drum 135 is released, by the clutch assembly 300 (see FIG. 9C).

In this case, if the driving motor 200 is operated, to rotate the rotor assembly 250 in a clockwise direction, the lower washing shaft 115 and the lower spinning shaft 125 rotate at the same speed.

Therefore, the sun gear 131 and the drum 135 rotate at the same speed, to revolve the planet gears 133 engaged with, and between the sun gear 131 and the drum 135 at speed and direction the same with the sun gear 131 and the drum 135 in a state the planet gears 133 do not rotate.

Accordingly, the agitating device and the inner tub 30 rotate at the same speed along the clockwise direction by the carrier 134 and the upper spinning shaft 121.

Figure 10A:
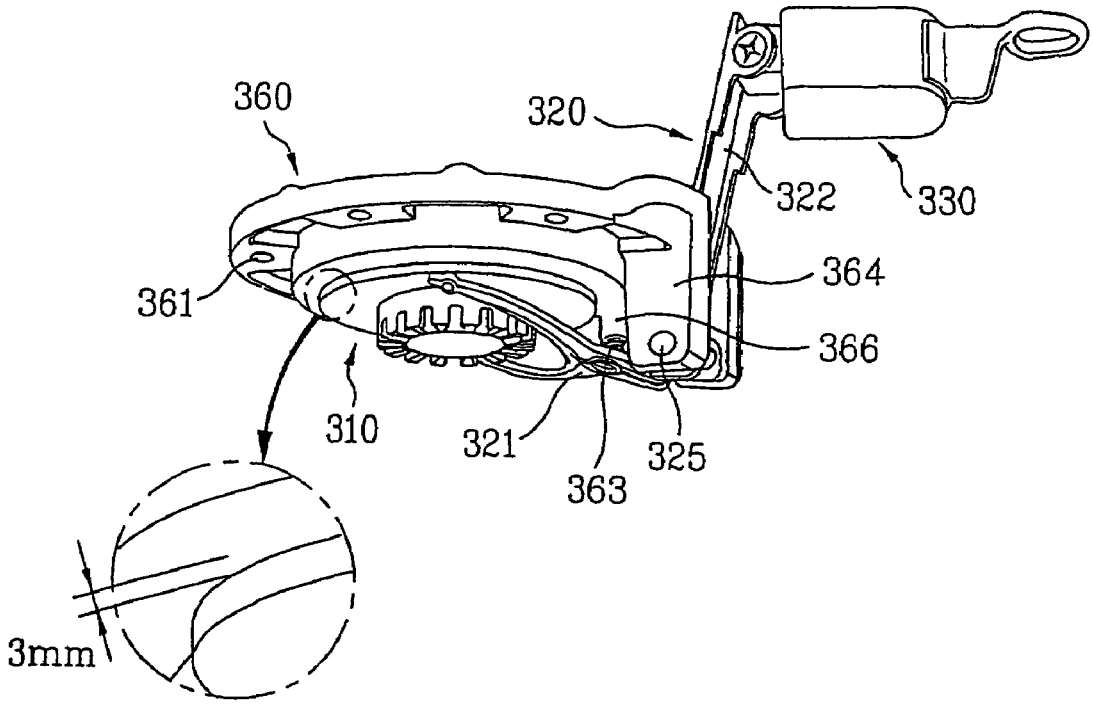
Figure 10B:
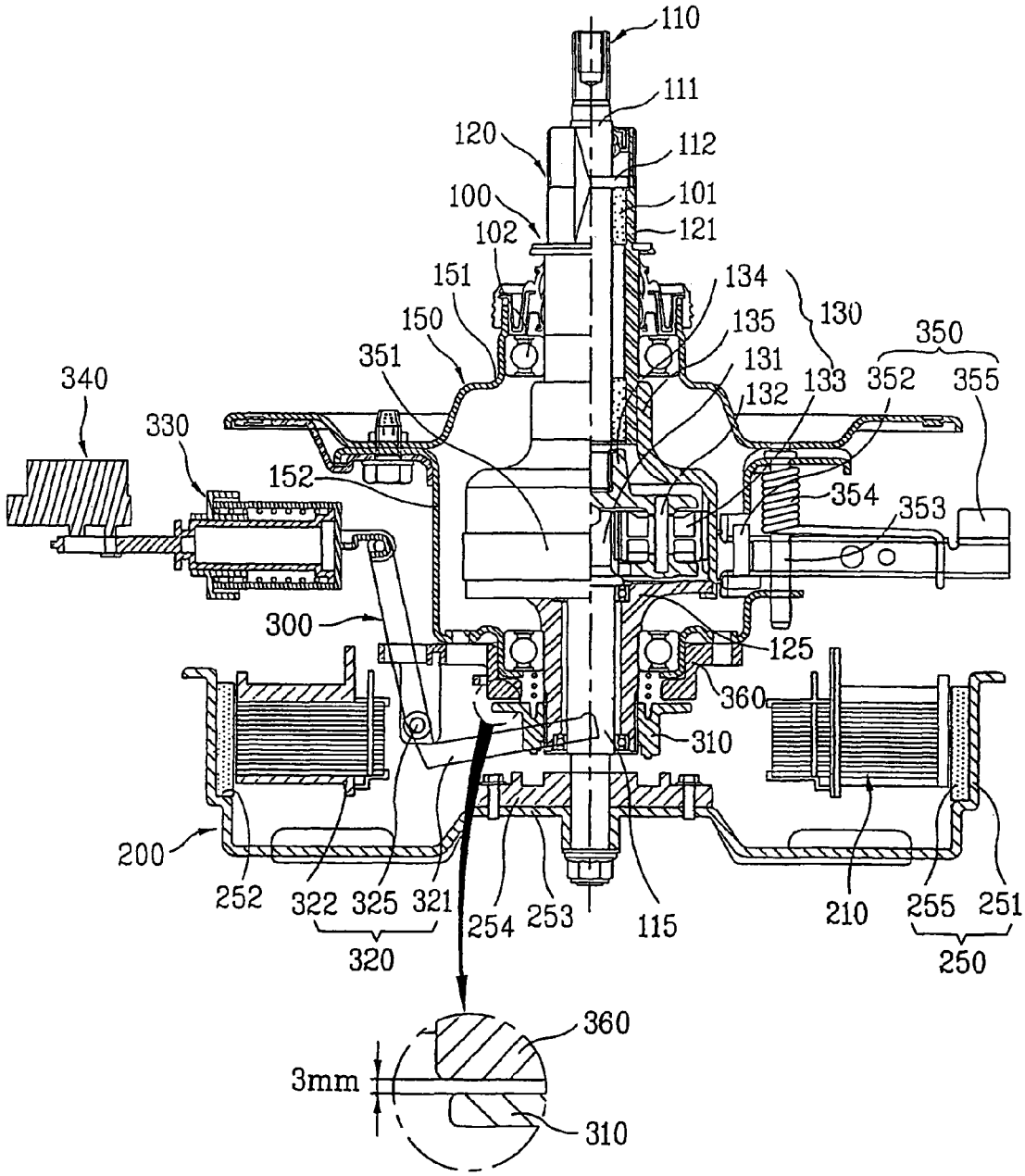
FIG. 10B illustrates a partial section showing positions of a motor, a power transmission device, and a clutch assembly.
Figure 10C:
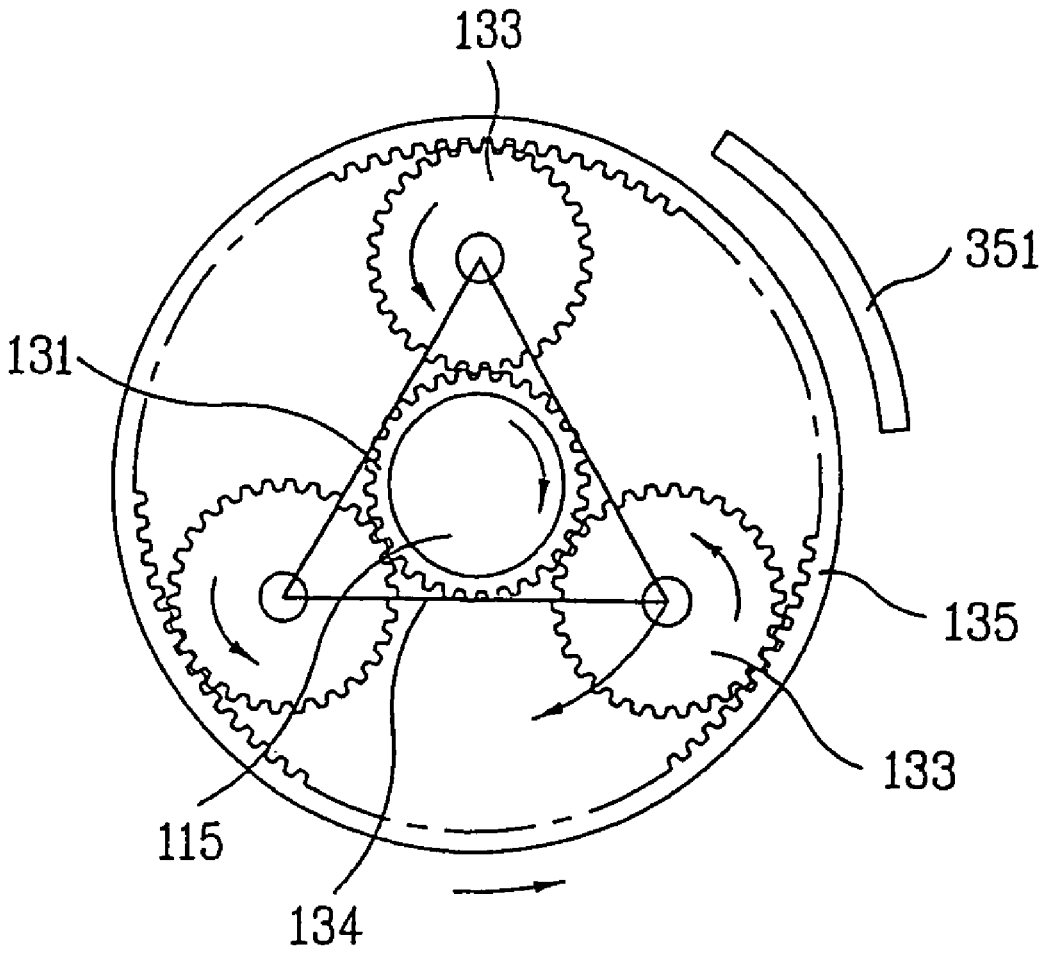
FIG. 10C illustrates a section showing a relation between gears and a brake pad in the power transmission device in FIG. 10B.

Lastly, a case will be review, in which the lower spinning shaft 125 is broken away from the rotor assembly 250, and the braking on the drum 135 is released (see FIG. 10C).

In this case, if the driving motor 900 is operated, to rotate the rotor assembly 250 in a clockwise direction, the sun gear 131 rotates in a clockwise direction, and the planet gears 133 rotate in a counter clockwise direction, as well as revolve around the sun gear 131 in a direction the same with the rotation direction of the sun gear 131, i.e., the clockwise direction. Accordingly, the carrier 134, the upper washing shaft 111, and the agitating device rotate in the clockwise direction.

Meanwhile, since the braking on the drum 135 has been released, when the planet gears 133 revolve, the drum 135 rotates in a direction opposite to the revolution direction of the planet gears 133, i.e., in a direction opposite to the rotation direction of the carrier 134 (a counter clockwise direction). Accordingly, the both the upper spinning shaft 121 and the inner tub 30 rotates in a counted clockwise direction.

Consequently, in this case, the agitating device and the inner tub 30 rotate in directions different from each other.

Referring to FIG. 3, an intermediate part of the power transmission device 100 is protected by a housing 150. The housing 150 includes an upper housing 151 and a lower housing 152, which are fastened with screws.

There are an upper bearing 102 between the upper spinning shaft 121 and the upper housing 151, and a lower bearing 103 between the lower spinning shaft 125 and the lower housing 152. The upper bearing 102 and the lower bearing 103 support the spinning shaft 120 so as to rotate, securely.

The housing 150 is fixed to a bracket (not shown) fixed to inside of the cabinet 10 of the washing machine, rigidly.

In the meantime, the washing shaft 110 of the power transmission device 100 is connected to the driving motor, directly. As shown in FIG. 3, the driving motor 200 includes a rotor assembly 250 and the stator assembly 210. The rotor assembly 250 has magnetism, and directly connected to the washing shaft 110, more specifically, the lower washing shaft 155, in a part outside of the outer tub 20. The stator assembly 210 has a hollow, and arranged in the rotor assembly 250. Since the stator assembly 210 is fixed, when power is applied to the stator assembly 210, the rotor assembly 250 rotates, together with the lower washing shaft 115.

Figure 4:
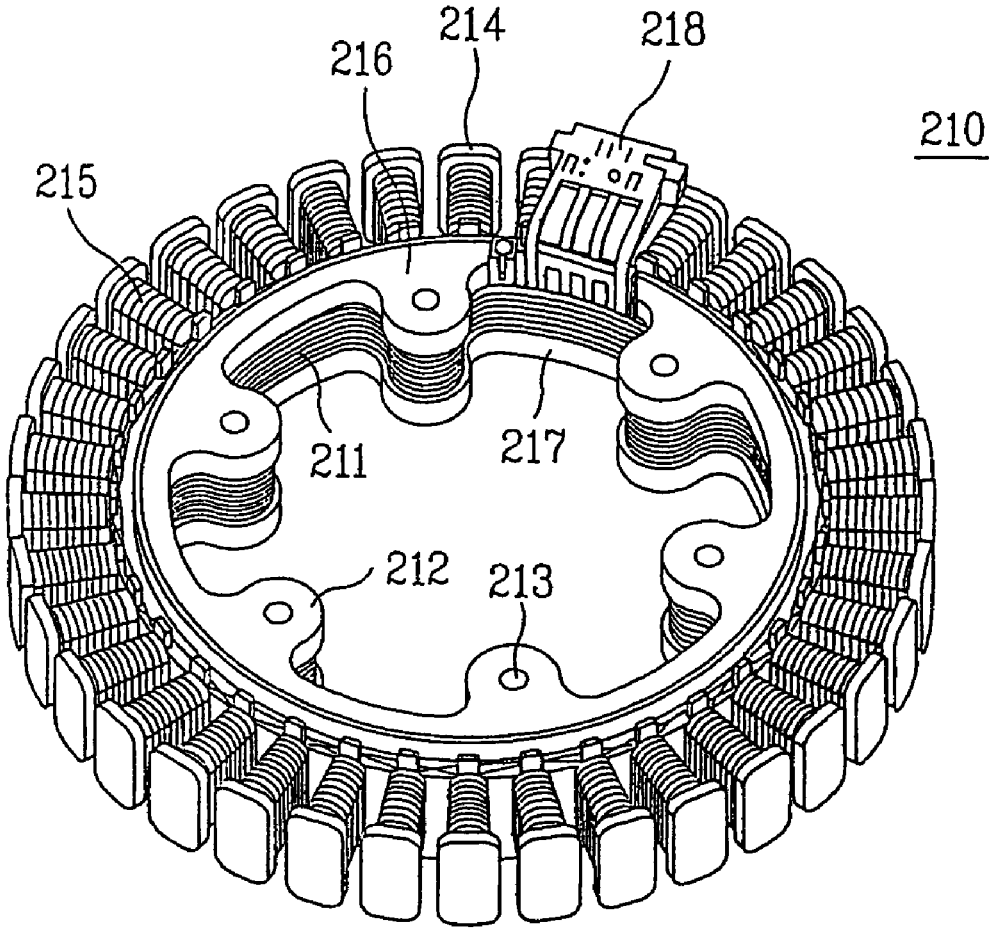
FIG. 4 illustrates a perspective view of a stator of the motor in FIG. 3.

FIG. 4 illustrates the stator assembly 210. Referring to FIG. 4, there are many layers of thin plates of magnetic material are stacked to form a magnetic core 211. In more detail, the magnetic core 211 has a stack of a plurality of thin hollow iron plates. The magnetic core 211 has a plurality of projections 212 from an inside circumferential surface thereof at regular intervals, each with a fastening hole 213 pass therethrough. Therefore, after fastening members, such as screws or bolts are inserted in the fastening holes 213, and the fastening members are fastened to the housing 150, the stator assembly 210 can be fixed, rigidly.

The magnetic core 211 has a plurality of poles 214 projected from an outside circumferential surface thereof. It is preferable that the poles 214 are formed as one unit with the magnetic core 211, at regular intervals on the outside circumferential surface of the magnetic core 211.

The pole 214 has a coil 215 wound around thereof. The coil 215 is connected to a terminal 218 at one side of the magnetic core 211. Therefore, when power is applied to the coil 215, the pole 214 and the coil 215 serve as electric magnets forming magnetic fields.

There are an upper insulating material 216 and a lower insulating material 217 among the coils, the magnetic core 211 and the poles 214, for preventing direct contact between the coils 215, the magnetic core 211, and between the coils 215 and the poles 214.

Figure 5A:
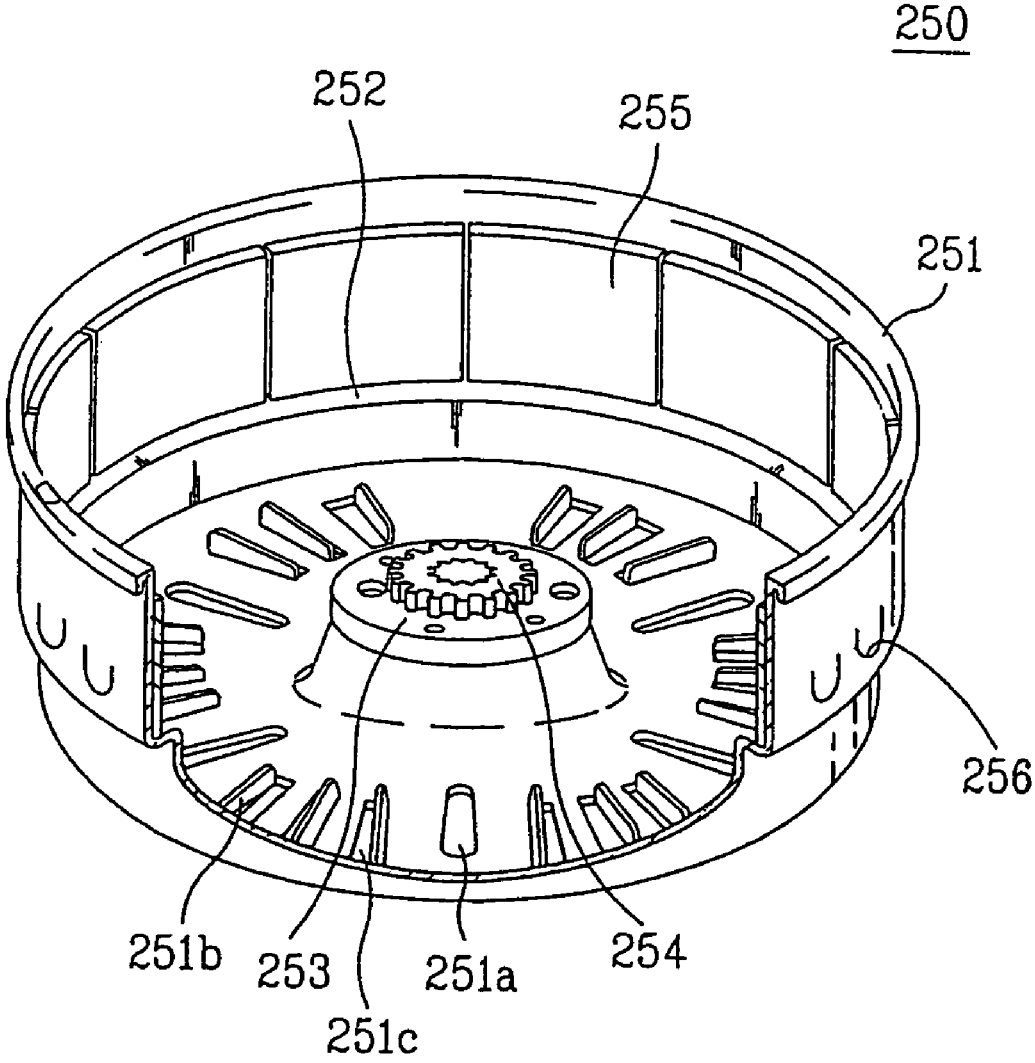
FIGS. 5A.about.5C illustrate perspective views of different embodiments of rotors applicable to the motor in FIG. 3, with partial cut away views.

FIG. 5A illustrates the rotor assembly. Referring to FIG. 5A, the rotor assembly 250 includes a rotor frame 251 and permanent magnets 255 attached to an inside circumferential surface of the rotor frame 251.

The rotor frame 251 is formed of a magnetic material, for an example, iron, and has a cup form. As shown in FIG. 5A, the rotor frame 251 has a hub 253 projected from an inside bottom surface thereof, with a pass through hole 253*a* in a central part thereof for pass of the lower washing shaft 115.

The rotor frame 251 has steps 252 formed along an inside circumferential surface for supporting bottom ends of the permanent magnets 255. Therefore, the rotor frame 251 has a small diameter in a lower part starting from the steps 252, and a great diameter in an upper part starting from the steps 252. The rotor frame 251 can be formed easily by, for an example, pressing.

In the meantime, there is a serration 254 attached to, one surface of the rotor frame 251, more specifically, an upper surface of the hub 253. The serration may be formed of material separate from the rotor frame 251, and attached to the hub 253. The serration 254 has a plurality of teeth both on an outer circumferential surface, and an inner circumferential surface.

Referring to FIG. 3, according to above structure, the lower washing shaft 115 may be fitted to pass the serration 254 and the hub 253, and fixed. Since a lower end part of the lower washing shaft 115 engages with the inside circumferential surface of the serration 254, if the rotor assembly 250 rotates, the lower washing shaft 115 rotates, together with the rotor assembly 250.

In the meantime, in a state the lower washing shaft 115 is engaged with the rotor assembly 250, the serration 254 faces the lower end of the lower spinning shaft 125 in a state the serration is spaced a distance away from the lower end. The lower spinning shaft 125 has teeth in a lower end part corresponding to the teeth on the outside circumferential surface of the serration 254. According to this, a clutching coupler 310 of the clutch assembly 300 to be described later moves up/down along the spinning shaft 125, to couple the lower spinning shaft 125 and the serration 254, selectively. This structure will be described in more detail at the time of description of the clutch assembly 300.

In the meantime, when the driving motor 200 is driven, the driving motor 200 generates much heat. Therefore, a stricture is required for discharging the heat to an outside of the motor. For this, the rotor frame 251 is formed of iron with a good thermal conductivity, and the rotor frame 251 has a plurality of heat discharge holes 251*a*, and first cooling blades 251*b*.

The first cooling blade 251*b* is formed by incising a part of a bottom surface of the rotor frame 251 to have a curve, and bending the part of incised bottom surface to an inside of the rotor frame 251. Then, as shown in FIG. 5A, the first cooling blade 251*b* projected to an inside of the rotor frame 251, and a pass through hole 251*c* at a side of the first cooling blade 251*b* are formed at a time.

Above structure enables introduction of air through the pass through hole 251*c* and blowing the air toward the stator assembly 210 with the first cooling blade 251*b*, when the rotor assembly rotates. The air, circulated, and cooled an inside of the driving motor 200, is discharged to an outside of the driving motor 200 through the heat discharge holes 251*a*. Thus, the driving motor 200 can be cooled down, effectively.

In the meantime, it is required that driving motors for washing machines with different capacities have different outputs. A washing machine with a small capacity has a motor with a low output, and a washing machine with a large capacity has a motor with a high output. However, the driving motors with different outputs have different sizes of the stator assembly 210, and the rotor assembly 250.

If the same stator assembly 210 is applied, the capacity of the driving motor 200 can be changed, because change of an intensity of a magnetic field formed in the driving motor 200 changes an induced electromotive force formed by the stator assembly 210.

Therefore, for maximum interchangeability of parts between washing machines with different capacities, different sizes of the permanent magnets 255 are applied to the same size stator assemblies 210 in fabrication of the washing machine with different capacities. However, the application of different sizes of the permanent magnets 255 requires change of a structure of the rotor frame 251. That is, change of a height of the step 252 that supports a bottom end of the permanent magnet 255 is required.

Figure 5B:
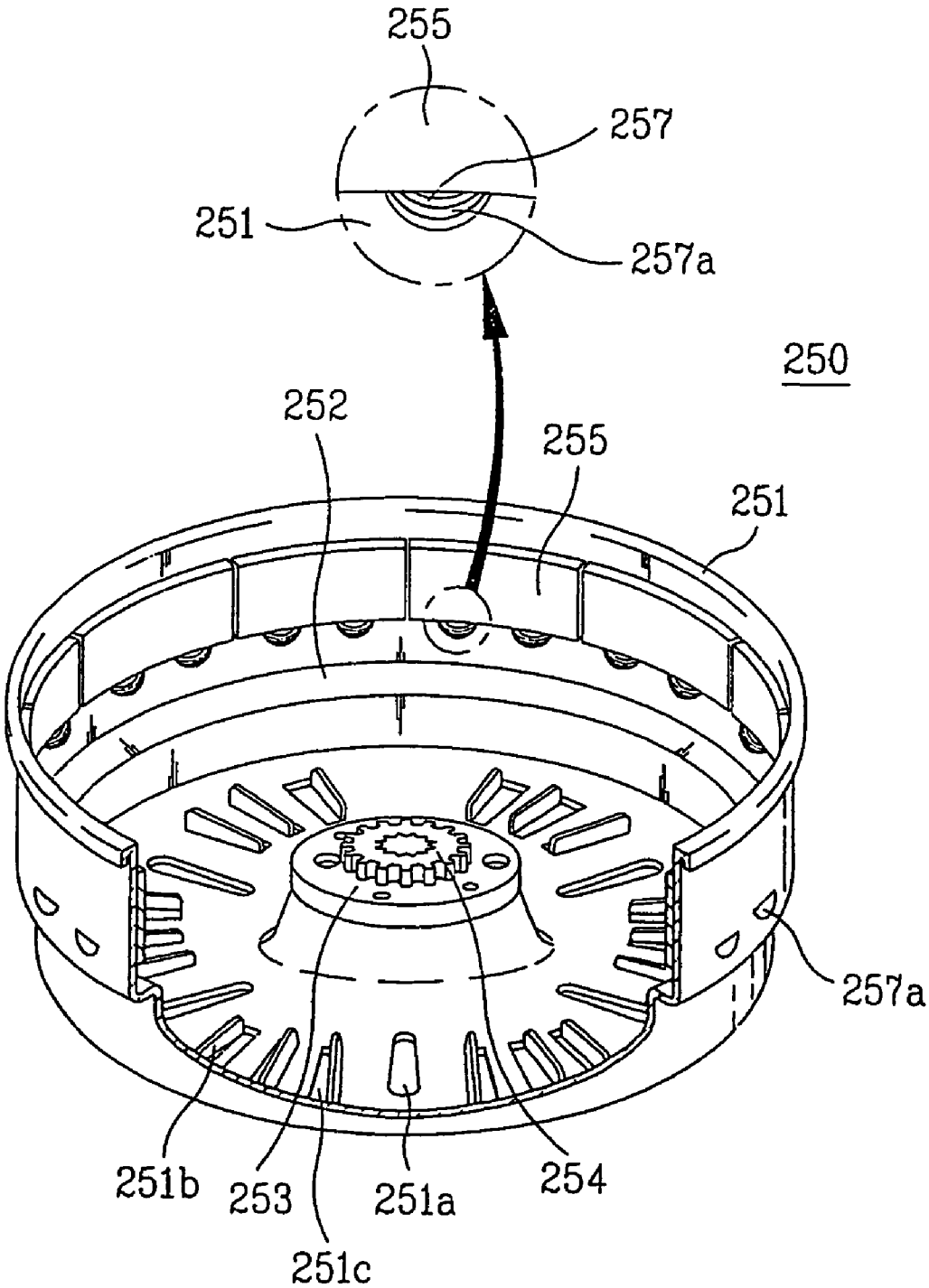

According to this, the present invention suggests a structure in which, if capacities of the washing machine differ, the rotor frame 251 can be applied to the washing machine of different capacities interchangeably without much change of the structure of the rotor frame 251. Such a structure is illustrated in FIGS. 5A and 5B, which will be described in more detail.

Referring to FIG. 5A, the rotor frame 251 has a plurality of incisions 256 along an outside circumferential surface of the rotor frame 251. As shown in FIG. 5B, since the incision 256 is curved, a part of the rotor frame 252 adjoining to the incision 256, more specifically, a part surrounded by the incision 256 may be pushed into an inside, to from a rib 257. There is a pass through hole 257*a* formed in a part having a part of the rotor frame 251 bent for forming the rib 257.

It is preferable that the incision 256 of above form is arranged between a top end of the rotor frame 251 and the step 252. For reference, even though FIGS. 5A and 5B illustrate a case an arc of the incision 256 directs downward, the arc may direct upward.

However, in both of the cases when a part of the rotor frame 251 adjoining to the incision 256 is bent to form the rib 257, it is preferable that an upper surface of the rib 257 is flat enough to support the bottom end of the permanent magnet 255, securely.

The rotor frame 251 with above structure enables to change the output of the driving motor 200 with easy without change of structure of other parts of the driving motor 200.

That is, referring to FIG. 5A, in a case large permanent magnets 255 are fitted to the rotor frame 251 for providing a large output, the permanent magnets 255 are attached by using the steps 252 in a state the part of the rotor frame 251 adjoining the incisions 256 are not bent.

Opposite to this, as shown in FIG. 5B, in a case small permanent magnets 255 are fitted to the rotor frame 251 for providing a small output, the permanent magnets 255 are attached on the ribs 257 formed by bending the part of the rotor frame 251 adjoining the incisions 256.

Figure 5C:
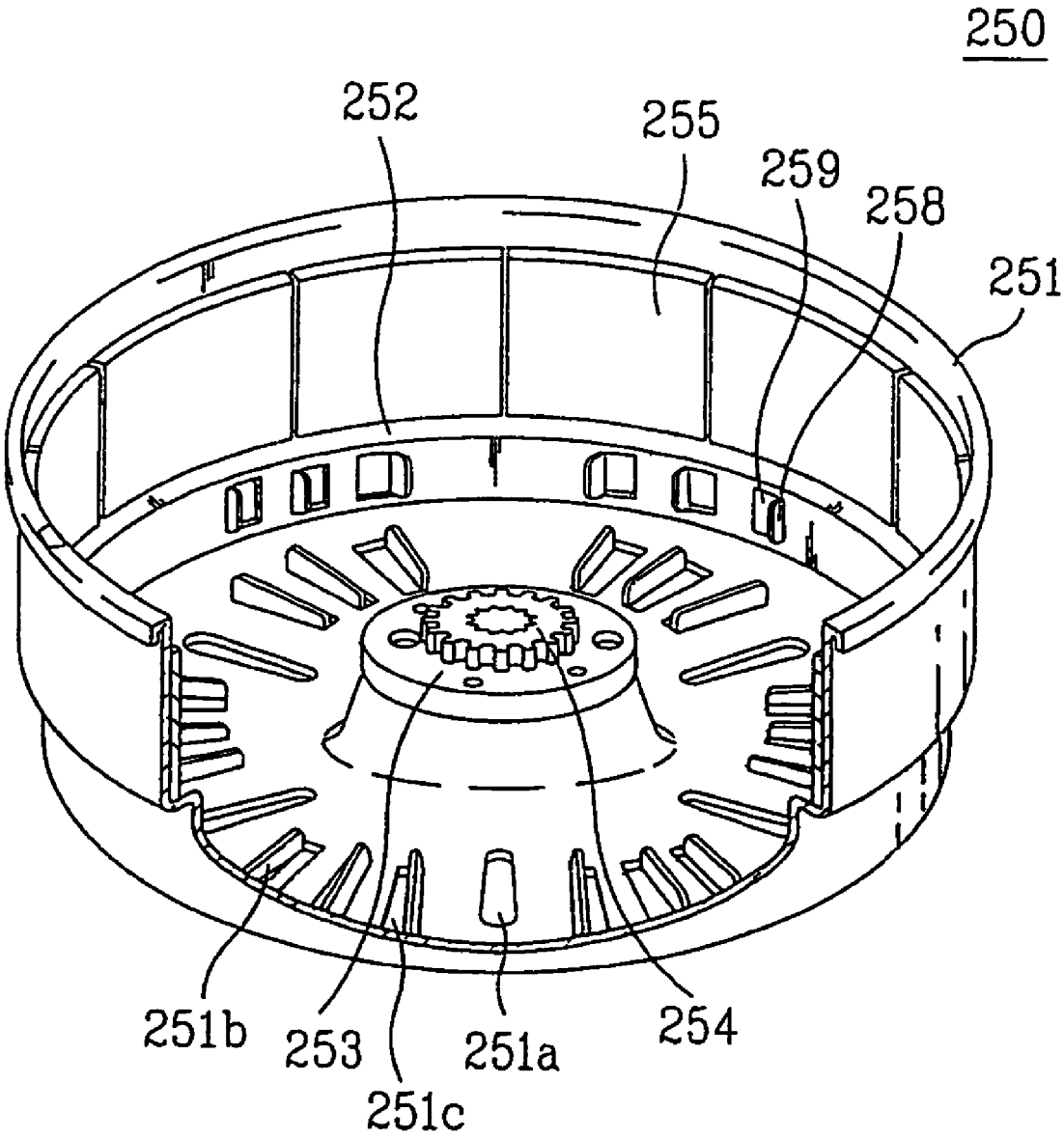

In the meantime, besides the first cooling blades 251*b* and the pass through holes 251*a*, the driving motor 200 of the present invention is provided with a structure for improving a cooling performance. FIG. 5C illustrates the structure, which will be described in more detail.

Referring to FIG. 5C, the rotor frame 251 has second cooling blades 25S on an inside circumferential surface. The second cooling blade 258 is formed by incising a part of an outside circumferential surface of the rotor frame 251, with a curve, and bending the incision to an inside of the rotor frame 251. According to this, there is a pass through hole 259 at a side of the second cooling blade 258.

The second cooling blade 258 is provided in a lower part of the rotor frame 251, more specifically, in a lower part of a side surface of the rotor frame 251 between the step 252 and the bottom surface of the rotor frame 251. As shown in FIG. 5C, the second cooling blade 258 is formed along a length direction of the rotor frame 251, and a plurality of the second cooling blades 258 are arranged along a circumferential direction of the rotor frame 251.

In the meantime, referring to FIG. 5C, it can be noted that positions of the second cooling blades 258 and the pass through holes 259 differ. That is, some of the second cooling blades 258 are formed, by incising each of the parts of the rotor frame 251 so as to direct an arc of an incision in a direction of rotation of the rotor frame 251, and bending the incision, and rest of the second cooling blades 258 are formed, by incising each of the parts of the rotor frame 251 so as to direct the arc of the incision in a direction opposite to the direction of rotation of the rotor frame 251, and bending the incision.

The incisions of the second cooling blades 258 are formed in opposite directions in the rotor frame 251 thus under the following reason.

In order to form the second cooling blade 258, a part of a side surface of the rotor frame 251 is incised. In this instance, all the incisions have the same direction, in applying a pressure to the rotor frame 251 with an incising tool, there is a minute slip of the incising tool taken place in one direction of the rotor frame 251.

The slip of the rotor frame 251 during the incision impedes fabrication of the second cooling blade 258 at an accurate dimension. The inaccurate dimension of the second cooling blade 258 causes rotation of the rotor assembly 250 in an eccentric state, or much noise. Therefore, for preventing those, the directions of incisions of the second cooling blades 258 differ.

Next, the agitating device and the inner tub 30 rotate not only one direction when the washing machine carries out washing. That is, for maximizing a friction force caused by water circulation, the agitating device and the inner tub 30 are rotated in a clockwise direction and counter clockwise direction, alternately.

If the incisions are made in the same direction, and bent to form the second cooling blades 258 in the same direction, the second cooling blades 258 are not functional for one of rotation directions of the rotor assembly 250.

Because a direction of air flow introduced into the pass through hole 259 changes, such that the second cooling blade 258 can not guide the air flow toward the stator assembly 210.

Therefore, the directions of the incisions in the rotor frame 251 differ in formation of the second cooling blades 258, for solving above problem.

In the meantime, the stator assembly 210 generates excessive heat when the washing machine carries out water extraction, i.e., when the agitator and the inner tub 30 spin. Therefore, it is preferable that the second cooling blades 258 have a high cooling capability in the spinning.

For this, a number of the second cooling blades 258 incised, and bent along a direction of rotation of the rotor assembly 250 in the spinning is different from rest of the number of the second cooling blades 258, specifically, it is preferable that a number of the second cooling blades 258 incised, and bent along a direction of rotation of the rotor assembly 250 in the spinning is greater than rest of the number of the second cooling blades 258.

Above structure enables that the greater number of the second cooling blades 258 can blow the air introduced through the pass through holes 259 toward the stator assembly 210, thereby enhancing a cooling performance.

In the meantime, referring to FIG. 5, a structure is illustrated, in which a plurality, for an example, three adjacent second cooling blades 258 form one cooling blade set. The cooling blade sets are formed along a circumferential direction of the rotor frame 251 at regular intervals.

Of the plurality of second cooling blades 258 in each of the cooling blade sets, some of the second cooling blades 258 are incised, and bent along a direction of rotation of the rotor assembly 250 in the spinning, and rest of the number of the second cooling blades 258 are incised, and bent along an opposite direction of rotation of the rotor assembly 250, wherein a number of the former is greater than a number of the latter.

Thus, the cooling blade sets are arranged at regular intervals for effective prevention of eccentricity and vibration of the rotor frame 251 at the time of rotation of the rotor assembly 250.

As described before, in the driving motor 200 of the present invention, the rotor assembly 251 is formed of iron. Moreover, the rotor frame 251 has a plurality of heat discharge holes 251*a*, the first cooling blades 251*b*, and the first pass through holes 251*c* formed by the first cooling blades 251*b* in a bottom. Moreover, the rotor frame 251 has a plurality of the second cooling blades 258, and the second pass through holes 259 formed by the second cooling blades 258.

Above structure enables discharge of heat generated at the time of operation of the driving motor 200 to an outside of the driving motor 200 through the rotor frame 251 with easily, enough to dispense with any additional components for discharge of heat from the driving motor 200, permitting easy fabrication and reduction of component cost.

Moreover, the rotor frame 251 has a plurality of curved incisions 251 in the outside circumference, using which the ribs 257 projected to an inside of the rotor frame 251 can be formed easily. At the time of changing a size of the permanent magnet 255 for changing the output of the driving motor 200, different sizes of the permanent magnets can be supported on ribs 257 or the steps 252. According to this, the interchangeability of man), components in fabrication of washing machines with different capacities enables saving a production cost.

In the meantime, the driving power of the driving motor 200 is transmitted to the spinning shaft 120, more specifically to the lower spinning shaft 125, selectively by the clutch assembly 300 depending on operation modes of the washing machine, which will be described, in more detail.

Referring to FIG. 3, the clutch assembly 300 has a clutching coupler 310 for making selective engagement of the spinning shaft 120, more specifically the lower spinning shaft 125, with the rotor assembly 250, more specifically the serration on the rotor frame 251. The clutching coupler 310 has teeth on an inside circumferential surface for engagement with the teeth on an outside circumferential surface of the serration 254 and/or the lower spinning shaft 125.

The clutching coupler 310 moves up/down along a length direction of the lower spinning shaft 125 in a state an inside circumferential surface thereof is engaged with the lower spinning shaft 125 and the serration. As the clutching coupler 310 is engaged with the serration 254 of the rotor assembly 250 selectively, the clutching coupler 310 transmits the rotating power from the rotor assembly 250 to the lower spinning shaft 125, selectively.

For an example, when the clutching coupler 310 moves down, an upper part of the clutching coupler 310 is engaged with the lower spinning shaft 125, and a lower part of the clutching coupler maintains a state of engagement with the serration 254. According to this, a rotation power of the rotor assembly 250 is transmitted to the lower spinning shaft 125.

Opposite to this, when the clutching coupler 310 moves up, to disengage the clutching coupler 310 from the serration 254, the rotation power of the rotor assembly 250 is not transmitted to the lower spinning shaft 125.

Thus, according to above principle, the clutching coupler 310 can transmit the rotation power from the rotor assembly 250 to the washing shaft 110, selectively.

In the meantime, the clutch assembly 300 is also provided with an elevating device for moving up/down the clutching coupler 310. As shown in FIG. 3, the elevating device includes a clutch lever 320 and a clutch motor 340.

The clutch lever 320 has one end connected to the clutching coupler 310, and one middle point connected to a hinge shaft 325. Therefore, if the other end of the clutching lever 320 is pushed or pulled, the clutching coupler 310 moves up or down.

In the meantime, if the clutch lever 320 is straight and long, fitting of the clutch lever 320 is difficult. According to this, the present invention suggests that the clutch lever 320 has an "L" form of bent structure.

In the "L" form of bent structure, a horizontal part 321 is in engagement with the clutching coupler 310, such that, when the lower spinning shaft 125 is engaged with the serration 254 on the rotor assembly 250, the clutching coupler 310 rotates with the lower spinning shaft 125 and the rotor assembly 250. Therefore, the horizontal part 321 is not joined with the clutching coupler, but supports a bottom of the clutching coupler 310. As shown in FIG. 8, the horizontal part 321 is forked at one end, for more stable supporting of the clutching coupler 310.

A vertical part 322 has the other end coupled to the clutch motor 340, and one end connected to the hinge shaft 325. Therefore, when the clutch motor 340 pulls the vertical part 322, the clutch lever 320 rotates around the hinge shaft 325, and, according to this, the horizontal part 321 moves up the clutching coupler 310.

In the meantime, the clutch motor 340 is arranged to pull or push the other end of the clutch lever 320, more specifically, the vertical part 322. Though the clutch motor 340 may be connected to the clutch lever 320 directly, it is preferable that the clutch motor 340 is connected to the clutch lever 320 indirectly through a connection link 330.

Referring to FIG. 3, the connection link 330 includes a first part 331 connected to the clutch lever 320, a second part 332 connected to the clutch motor 340 having one part inserted in the first part 331, and a spring 333 having opposite ends connected to the first part 331 and the second part 332.

Above structure enables that the spring 333 absorbs a momentary impact generated when the clutch motor 340 pushes, or pulls the second part 322 before the force of pushing or pulling is transmitted to the first part 331. According to this, the clutch lever 320 is always pushed or pulled smoothly, to prevent breakage caused by momentary movement of the clutching coupler 310 and hitting other components.

In the meantime, for limiting a moving up height of the clutching coupler 310 that moves up/down along the lower spinning shaft 125 by the elevating device, the clutch assembly 300 is provided with a stopper 360. The stopper is shown in FIGS. 3 and 8A, which will be described in more detail.

Referring to FIG. 3, the stopper 360 is fixed to the housing 150, more specifically the lower housing 152 over the clutching coupler 310. For reference, as shown in FIG. 8A, the stopper 360 has holes 361 for fastening screws or bolts. As shown in FIG. 8A, the stopper 360 has a downward extension 364 from one side, to which the hinge shaft 325 is connected.

For smooth operation of the clutch lever 320, there is a spring 363 inserted between the horizontal part 321 of the clutch lever 320 and the underside of the stopper 360. For this, the stopper 360 has a boss 366 projected from the underside for inserting and fixing one end of the spring 363 thereto.

Of course, spring 363 also serves to break the clutch lever 320 away from the clutching coupler 310 by pushing the horizontal part 321 of the clutching lever 320 downward when the clutching coupler 310 and the serration are engaged with each other, and rotate.

In the meantime, the clutching coupler 310 comes into contact with the stopper 360 as the clutching coupler 310 moves up/down. Accordingly, for preventing an occurrence of impact when the clutching coupler 310 comes into contact with the stopper 30 in a strong power, a spring may be provided between the clutching coupler 310 and the stopper 360. In this case, the clutching coupler 310 has a groove in an upper surface for inserting one end of the spring therein. For reference, FIG. 3 illustrates an example when the spring is provided between the clutching coupler 310 and the lower bearing 103. Even if the spring is provided thus, the same effect can be obtained.

In the meantime, the stopper 360 not only limits the moving up height of the clutching coupler 310, but also prevents rotation of the clutching coupler 310 engaged with the clutching coupler 310 with the serration.

For this, referring to FIG. 8A, the stopper 360 has recesses 365 in the underside of the stopper 360, and the clutching coupler 310 has projections from the upper surface of the clutching coupler 310 to be inserted in the recesses 365. However, opposite to this, the recesses 365 and the projections 315 may be formed in the clutching coupler 310 and the stopper 360, or may be formed in the clutching coupler 310 and the stopper 360 alternately for engagement to each other.

Above structure enables rotation of the clutching coupler 310 as the projections 315 are inserted in the recesses 365 when the clutching coupler 310 is moved up. According to this, the rotation of the spinning shaft 120 engaged with the clutching coupler 310 with the serration can be prevented.

In the meantime, in the foregoing washing machine of the present invention, if the washing shaft 110 and the spinning shaft 120 are simply connected to the agitating device and the inner tub 30 respectively, it is adequate for the clutch assembly 300 to have the foregoing structure only. Of course, in this case, the power transmission device 100 may rotate the agitating device only, or both the agitating device and the inner tub 30 in the same direction, together.

However, in the washing machine of the present invention, a gear device 130 is further provided to the power transmission device 100, for functioning as a planetary gear device that can rotate the agitating device and the inner tub 30 in different directions. In this case, for proper control of the power transmission device 100 that rotates the agitating device and the inner tub 30, it is required that rotation of the washing shaft 110, more specifically, the drum 135 directly connected to the washing shaft 110, is intermitted according to operation modes different from each other.

Accordingly, the clutch assembly 300 in the washing machine of the present invention is further provided with a separate brake assembly 350 for intermitting rotation of the drum 135 that functions as a ring gear of the planetary gear. The brake assembly 350 will be described in more detail with reference to FIGS. 3 and 7.

The brake assembly 350 intermits rotation of the drum 135. Since the drum 135 is respectively connected both to the upper spinning shaft 121 and the lower spinning shaft 125, the brake assembly 350 intermits rotation of the spinning shaft 120, at the end.

The brake assembly 350 has brake pad 351 arranged such that the brake pad 351 can be brought into contact with an outside surface of the drum 135 connected to the spinning shaft 120. Though the brake pad 351 is arranged to surround an outside circumference of the drum 135, the arrangement of the brake pad 351 is not limited to this, but it is adequate as far as the brake pad 351 are arranged adjacent to the outside surface of the drum 135 such that the brake pad 351 can be brought into contact with the outside surface of the drum 135, simply.

The brake pad 351 are arranged, such that the brake pad 351 come into contact with the outside surface of the drum 135 and brake the drum 135, when, for an example, there is no external force applied. However, opposite to this, it makes no difference even if the brake pad 351 are arranged, such that the brake pad 351 breaks away from the outside surface of the drum 135 when no external for is applied, and release the braking on the drum 135, and the brake pad 351 come into contact with the outside surface of the drum 135 and brake the drum 135, when there is an external force applied.

Thus, once the brake pad 351 are provided to the brake assembly 350, the brake pad 351 apply a friction force to the outside surface of the drum 135 connected to the spinning shaft 120, enabling to hold the spinning shaft 120. Moreover, as the brake pad 351 move away from the spinning shaft 120, the braking on the spinning shaft 120 can be released.

In the meantime, the brake assembly 350 of the present invention includes a brake lever 355 connected to the brake pad 351 for automatic control of the brake pad 351, and an operation motor 450 for pushing/pulling the brake lever 355.

The brake lever 355 is arranged to pass through the housing, specifically the lower housing 152, and has one end connected to the brake pad 351. There is a hinge shaft 352 in the middle of the brake lever 355. Therefore, if the other end of the brake lever 355 is pulled or pushed, the brake pad 351 wraps an outside circumference of the drum 135 and brakes the drum 135, or unwraps, and releases the drum 135.

In the meantime, referring to FIG. 3, there is a shaft 353 held in the lower housing 152, with a torsion spring 354 inserted thereon having ends held at the brake lever 355 and the lower housing 152, respectively Therefore, if a force is removed after pushing or pulling the other end of the clutch lever 320 with the force, the clutch lever 320 is restored to an original position by the force of the torsion spring 354. Moreover, the torsion spring 354 absorbs a momentary impact occurred when the clutch lever 320 is pulled or pushed.

Figure 7:
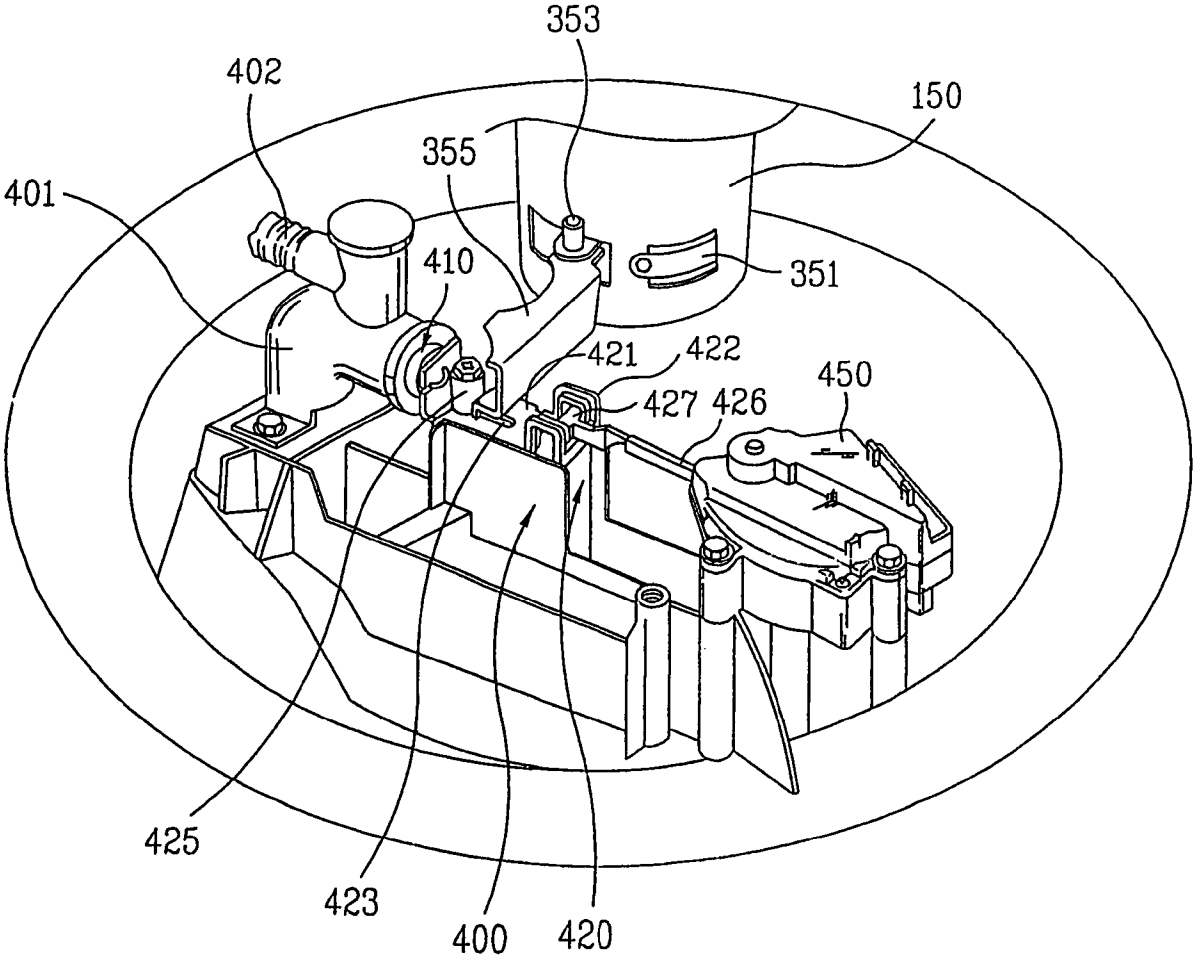
FIG. 7 illustrates a perspective view of a drain device, and a brake assembly of the washing machine in FIG. 2.

Referring to FIG. 7, the other end of the brake lever arranged thus is pushed or pulled by the operation motor 450. Though the operation motor 450 and the brake lever 355 may be connected directly, the present invention suggests connecting them indirectly.

That is, in the present invention, the brake lever 355 is connected to a drain lever 420 connected to a drain valve 410, and the drain lever 420 is connected to the operation motor 450. This structure enables simultaneous control of the drain device 400 and the brake assembly 350 only with the single operation motor 450, which will be described in more detail.

Figure 6:
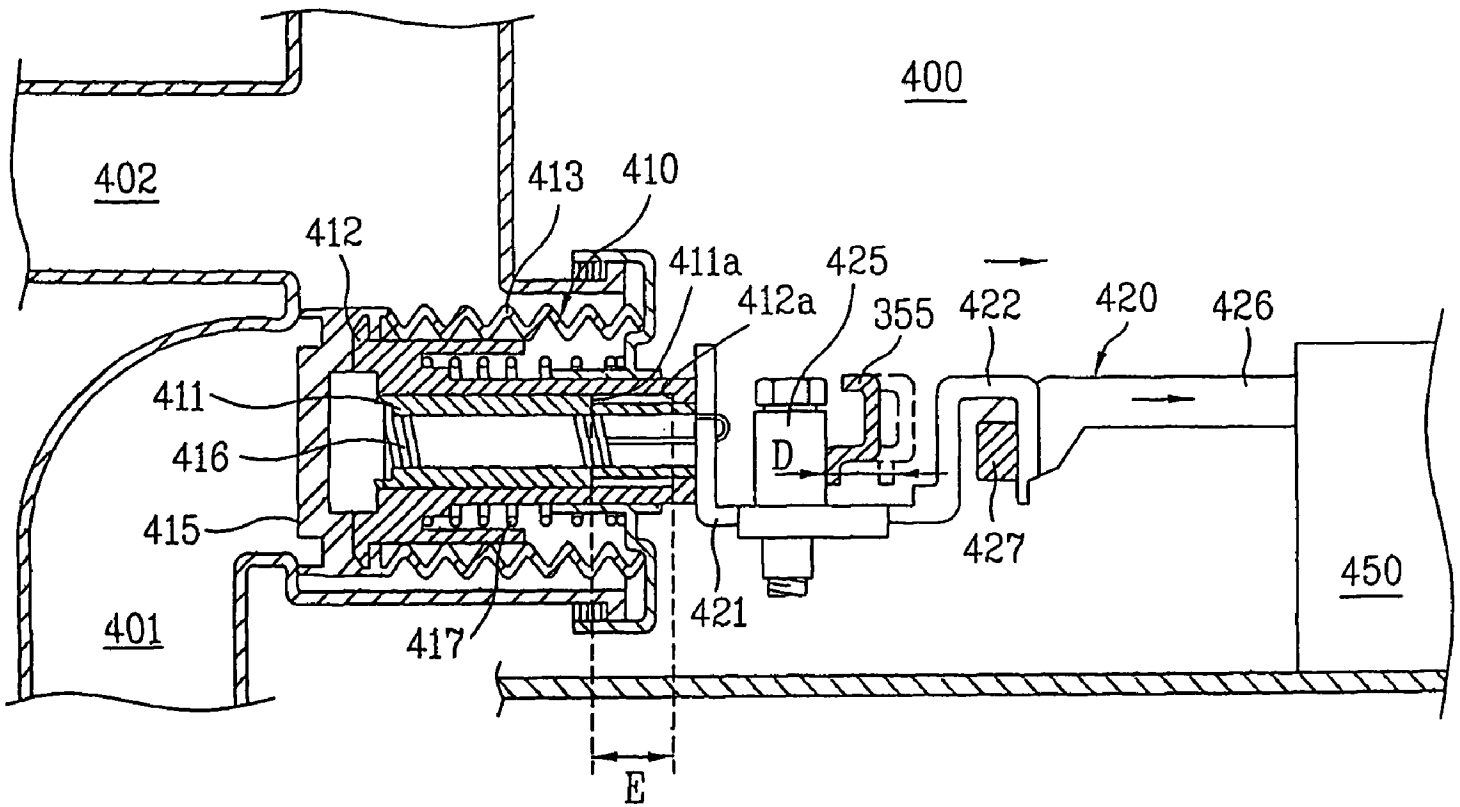
FIG. 6 illustrates a partial section of a drain device of the washing machine in FIG. 2.

Referring to FIGS. 2, 6, and 7, the drain device 400 for draining washing water from the outer tub 20 to an outside of the cabinet 10 will be described.

The drain device 400 includes a drain passage for making an outside of the cabinet 10 with the outer tub 20, the drain valve 410 for opening/closing the drain passage, and the operation motor 450 for opening/closing the drain passage by pulling or pushing the drain passage.

Referring to FIGS. 2 and 6, the drain passage includes a drain pipe 401 connected to an underside of the outer tub 20, and a drain hose 402 connected to the drain pipe 401. While one end of the drain pipe 401 is formed of a hard material for proper mounting, and operation of the drain valve 410, the drain hose 402 is formed of a flexible material for the user's easy bending.

The drain valve 410 is operated by the operation motor 450, to close/open the drain passage. The operation motor 450 may be connected to the drain valve 410, directly. However, in the present invention, since the single operation motor 450 controls both the drain valve 410 and the brake assembly 350, as shove in FIG. 6, the drain valve 410 is connected to the operation motor 450 with the drain lever 420.

Meanwhile, as described before, in the washing machine of the present invention, the agitating device and the inner tub 30 are operative in a variety of methods, such as only the agitating device rotates, the agitating device and the inner tub 30 rotate together in the same direction, or the agitating device and the inner tub 30 rotate in opposite directions at the same time.

Therefore, in order to control the drain valve 410 and the brake assembly 350 with the operation motor 450 at the same time, it is preferable that the operation motor 450 is controlled to have many operation modes. Moreover, it is preferable that the drain valve 410 is also operative in correspondence to the various operation modes of the operation motor 450, which will be described, in more detail.

In the washing machine of the present invention, the operation motor 450 is operative in a first step mode for intermitting rotation of the spinning shaft only, and a second step mode for releasing braking on the spinning shaft 120 and, at the same time, draining water from the outer tub 20.

If the operation motor 450 is operative thus, it is possible that rotation of the spinning shaft 120 can be intermitted in a state water is not drained from the outer tub 20. Accordingly, when the washing machine carries out washing or rinsing, rotation of the agitating device and the inner tub 30 can be controlled, effectively.

Moreover, because the operation motor 450 can control the spinning shaft 120 while water is draining from the outer tub 20, rotation of the agitating device and the inner tub 30 can be controlled effectively when the washing machine spins for extracting water.

For effective carrying out of the two operation modes by using the operation motor 450, it is required that a structure of the drain valve 410 is also changed. Therefore, the structure of the drain valve 410 will be described in more detail, with reference to FIG. 6.

Referring to FIG. 6, there are a packing 415 arranged to close the drain passage, and the second rod 412 arranged to connect to the packing 415. The second rod 412 has a first rod 411 connected thereto with a predetermined play 'E' therebetween. The structure in which the second rod 412 is connected to the first rod 411 with the play 'E' can be realized, for an example, as follows.

Referring to FIG. 6, the second rod 412 has a step 412*a* on an inside circumferential surface of the second rod 412, and the first rod 411 has a step 411*a* fit to the step 412*a*. When the first rod 411 is inserted in the second rod 412, the play as long as a length between the step 411*a* and the step 412*a* can be formed between the first rod 411 and the second rod 412.

Therefore, if the operation motor 450 is operated, for an example, in the first step mode, to pull the drain lever 420 the same with, or shorter than the play, for an example, to a first length, the first rod 411 moves to the first length, alone.

Opposite to this, in a case the operation motor 450 is in operation in the second step mode, to pull the drain lever 420 to a second length longer than the first length, not only the first rod 411, but also the second rod 412 move to the second length, together. According to this, since the packing 415 moves to open the drain passage, the washing water is drained from the outer tub 20.

In the meantime, referring to FIG. 6, there is a first spring 416 inserted in the first rod 411, having both ends connected to the packing 415 and the drain lever 420, respectively. There is a second spring 417 on an outside circumferential surface of the second rod 412, having both ends connected to an end of the second rod 412 adjacent to the packing 415, and the cap, respectively.

Above structure, not only attenuates a momentary impact applied to the drain valve 410 when the operation motor 450 starts, but also restores the first rod 411 and the second rod 412 to original positions by using the first spring 416 and the second spring 417 even if the operation motor 450 does not push the drain lever 420.

In the meantime, referring to FIG. 6, the drain valve 410 has a bellows 413 to wrap around the components except the packing 415. The bellows 413 provided thus enables the drain valve 410 to extend/contract while infiltration of water into an inside thereof prevented.

The drain lever 420 in the drain device 400 has the brake lever 355 of the brake assembly 350 connected thereto. As shown in FIGS. 6 and 7, the drain lever 420 includes a first rod 411, a first lever 421, and a second lever 426 connected to the operation motor 450.

The second lever 426 has a "T" formed connecting part 427, and the first lever 421 has a hanger 422 for receiving the connecting part 427. Therefore, in the drain lever 420, the first lever 421 and the second lever 426 can make relative movement.

Referring to FIGS. 6 and 7, the drain lever, specifically, the first lever 421 has the brake lever 355 connected thereto. The brake lever 355 is connected to a variable screw 425 movable along a slot 423 in the first lever 421. Therefore, as shown in FIG. 6, a position of the brake lever 355 connected to the drain lever 420 can be changed slightly within a small range of play 'D'.

Above structure enables simultaneous control of the drain valve 410 and the brake assembly 350 when the operation motor 450 is operated. Control of the drain valve 410 and the brake assembly 350 will be described for each of the operation modes of the operation motor 450.

First, when the operation motor is standstill, the brake lever 355 does not move. Therefore, the brake pad 351 keeps a state the brake pad 351 is in contact with the drum 135, to brake the drum 135 and the washing shaft 110, and, as shown in FIG. 6, the packing 415 closes the drain passage. Therefore, no water is drained from the outer tub 20.

Next, a case will be reviewed, when the operation motor 450 is operated in the first step mode. In the first step mode operation, the operation motor 450 pulls the drain lever 420 by the first length.

Then, since the brake lever 355 connected to the drain lever 420 is pulled by the first length, the brake pad 351 breaks away from the drum 135, to release braking on the drum 135.

In the meantime, in the drain valve 410, the first rod 411 moves by the first length alone. Therefore, since the second rod 412 and the packing 415 make no movement, no water is drained from the outer tub 20.

Thus, in the first step mode, the brake pad 351 releases braking on the drum 135, and the drain valve 410 closes the drain passage.

Lastly, a case will be reviewed, when the operation motor 450 is operated in the second step mode. For reference, the operation motor 450 can be move into the second step mode from the first step mode, or move into the second step mode from standstill, directly.

In the second step mode, the operation motor 450 pulls the drain lever 420 to the second longer than the first length. According to this, since the brake lever 355 connected to the drain lever 420 is pulled, the braking on the drum and the washing shaft 110 is released.

Since the play (the first length) between the first rod 411 and the second rod 412 in the drain valve 410 is shorter than the second length, the second rod 412 moves with the first rod 411 until the second length. Therefore, the packing 415 also moves, to drain water from the outer tub 20.

Thus, in the second step mode, the brake pad 351 releases the braking on the drum 135, and the drain valve 410 opens the drain passage.

In the meantime, the foregoing washing machine of the present invention is operative a variety of operation modes. Operation of above components will be described for each of the operation modes, with reference to FIGS. 8A.about.10C.

At first, the case of the first mode when only the agitating device rotates is applicable to a washing or ringing of the washing machine. In this case, the agitating device rotates in a regular or reverse direction by the rotor assembly 250, to cause water circulation in the inner tub 30 to wash or rinse the laundry.

In the meantime, the first mode may be applied for sensing an amount of the laundry introduced into the inner tub 30 before the washing machine starts the washing. That is, in a state no water is supplied to the washing machine, the agitating device is rotated, to sense the amount of laundry with reference to a load sensed at the time of rotation. The amount of laundry sensed at the time influences to an amount of water, an amount of detergent introduced into the outer tub 20, and time periods of washing and rinsing.

Operation of the components in a case the washing machine operates in the first mode can be known with easy from FIGS. 8A.about.8C.

Figure 8B:
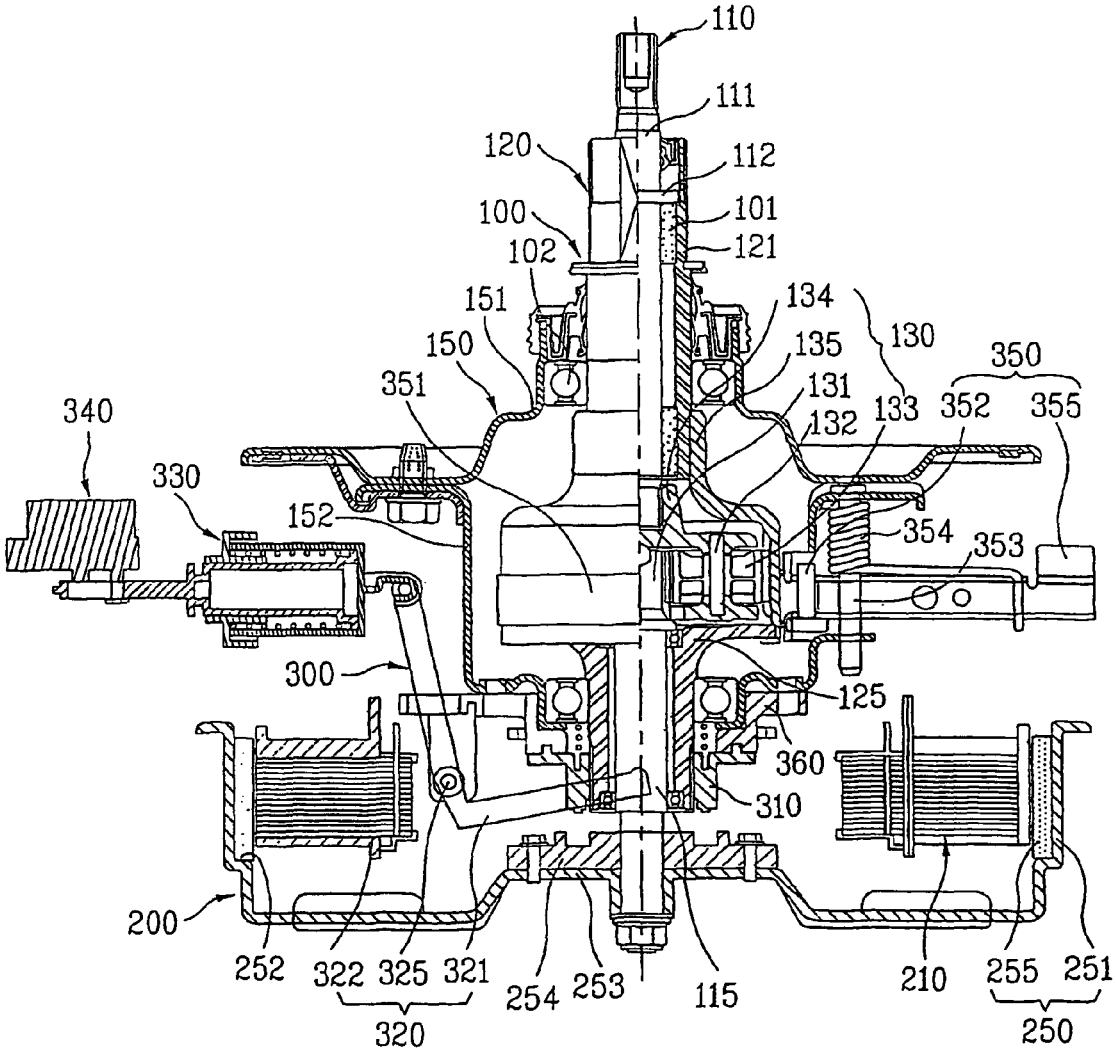
FIG. 8B illustrates a partial section showing positions of a motor, a power transmission device, and a clutch assembly.
Figure 8C:
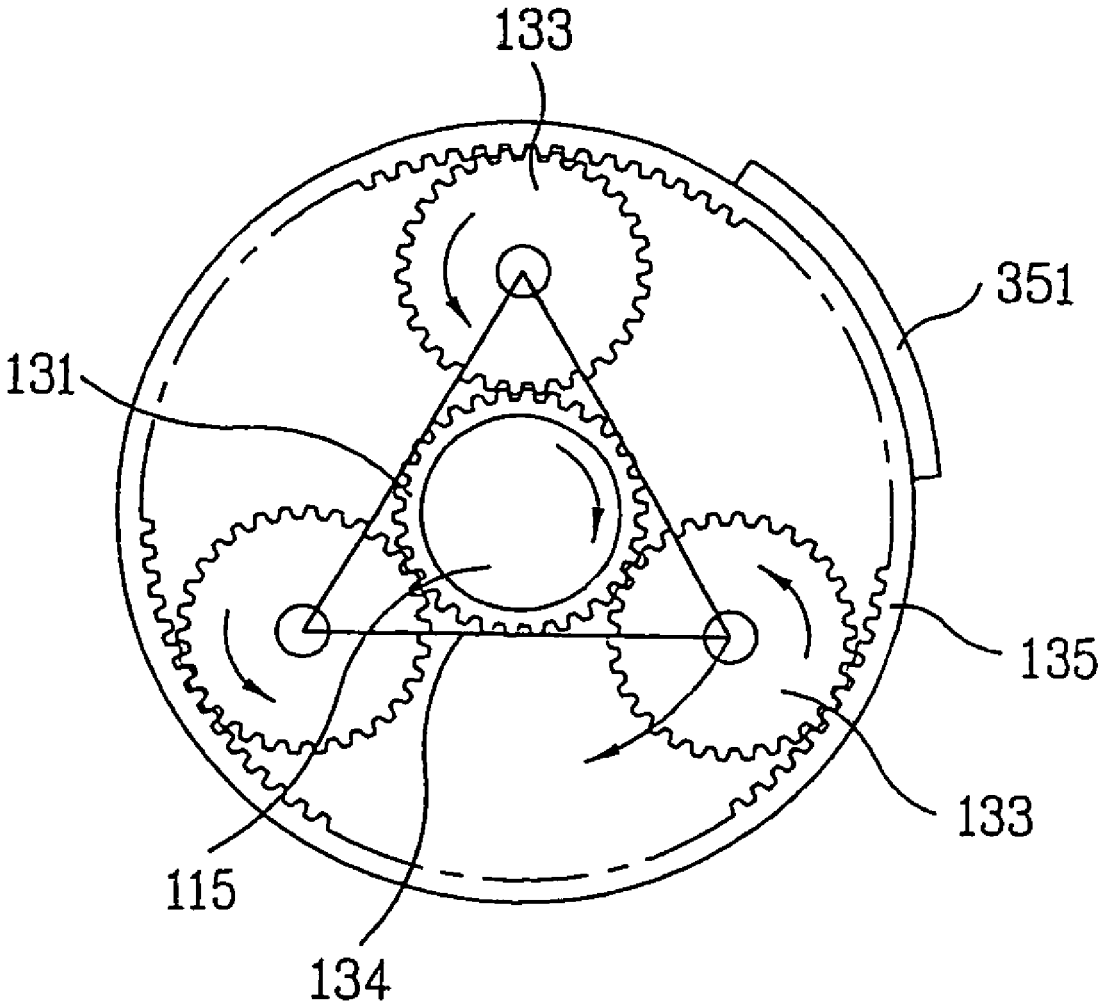
FIG. 8C illustrates a section showing a relation between gears and a brake pad in the power transmission device in FIG. 8B.

Referring to FIGS. 8A and 8B, in the first mode, the clutch assembly 300 separates the spinning shaft 120 and the rotor assembly 250. To do this, the clutch motor 340 pulls the clutch lever 320, to move the clutching coupler 310 up, and disengage the clutching coupler 310 and the serration 254 of the rotor assembly 250.

Referring to FIGS. 8A and 8B, the clutching coupler 310 moved up by the clutch lever 320 is brought into close contact with the stopper 360. In this instance, since the recesses 365 and the projections 315 are engaged to each other, the clutching coupler 310 and the spinning shaft 120 are joined.

In the meantime, in the first mode, the brake assembly 350 in the clutch assembly 300 brakes the drum 135. For this, the operation motor 450 is kept turned off.

In above state, referring to FIG. 8, if the rotor assembly 250 of the driving motor 200 rotates in a clockwise direction, the lower washing shaft 115 and the sun gear 131 rotate in the clockwise direction. Then, the planet gears 133 engaged with an outside circumference to the sun gear 131 rotate in the counter clockwise direction as well as revolves in the clockwise direction around the sun gear 131. According to this, the carrier 134, the upper washing shaft 111, and the agitating device rotate in the clockwise direction. Of course, if the rotor assembly 250 rotates in the counter clockwise direction, the power transmission device 100 rotates opposite to above, to rotate the agitating device in the counter clockwise direction.

Next, the case of the second mode when the agitating device and the inner tub 30 rotate in the same direction is applicable to washing, rinsing, and spinning of the washing machine.

The second mode is operative in three types subdivided depending on rotation speeds of the agitating device and the inner tub 30, and operation of the drain device 400. Accordingly, the second mode will be described, dividing the second mode into A-type, B-type, and C-type.

Before starting description, the A-type, B-type, and C-type will be described, briefly.

In the A-type, the agitating device and the inner tub 30 rotate at a high speed in the same direction in a state washing water and laundry are stored in the outer tub 20.

Then, the laundry is made to be brought into close contact with an inside wall of the inner tub 30 by a centrifugal force generated by the high speed rotation of the agitating device and the inner tub 30, and the washing water is made to pass through pass through holes (not shown) in the laundry and the inner tub 30, and, then, to be brought into close contact with the inside wall of the outer tub 20. Therefore, there is a "V" form of water circulation in the inner tub 30 and the outer tub 20.

The water moved to the inside wall of the outer tub 20 in this state rises along an inside wall of the outer tub 20 by a great centrifugal force, and drops down into an inside of the inner tub 30. A washing performance is improved further by the impact produced in this time. As described, in the A-type, the washing water forms a heart form of water circulation in the washing.

Next, in the B-type, the agitating device and the inner tub 30 rotate at a low speed. Therefore, in the B-type, though the "V" form of water circulation is formed, no heart form of water circulation is formed.

Accordingly, in the B-type, the washing or rinsing can be carried out in a state the laundry is attached to the inside wall of the inner tub 30, and the washing water is attached to the inside wall of the outer tub 20.

In the meantime, in the B-type, for enhancing washing performance, and rinsing performance, the agitating device and the inner tub 30 rotates together in a regular or reverse direction, alternately. The B-type is applicable to the washing or rinsing.

Lastly, in the C-type, the agitating device and the inner tub 30 rotate at an extra high speed, and together with this, the drain device 400 is operated, to drain water from the outer tub 20. Therefore) the C-type is applicable to spinning.

Meanwhile, in common for all of the types of the second mode, the clutch assembly connects the spinning shaft 120 and the rotor assembly 250, and the brake assembly 350 releases the braking on the drum 135 and the spinning shaft 120.

For this, referring to FIG. 9A, the clutch motor 340 is not put into operation. According to this, as shown in FIGS. 9A and 9B, the horizontal part 321 of the clutch lever 320 maintains a horizontal state, and the clutching coupler 310 moves down accordingly, to engage the lower spinning shaft 125 with the serration 254 on the rotor assembly 250.

The operation motor 450 of the brake assembly 350 is operated in the first step mode. Then, the drain lever 420 is pulled by a first length to operate the brake lever 355. According to this, the brake pad 351 moves away from the outside circumferential surface of the drum 135, and releases the braking on the drum 135 and the washing shaft 110.

Nevertheless, the second rod 412 of the drain valve 410 does not move, to keep a closed state of the drain passage, with no drain of the washing water.

In above state, referring to FIG. 9C, if the rotor assembly 250 rotates, the lower washing shaft 115, the sun gear 131, the lower spinning shaft 125, the drum 135 rotate at the same speed. Therefore, the planet gears 133 do not rotate, but revolve around the sun gear 131 in the same speed, and direction with the rotation speed and direction of the sun gear 131 and the drum 135. According to this, the agitating device coupled to the carrier 134, and the inner tub 30 coupled to the drum 135 rotate at the same sped, and direction.

Both the A-, and C-type carry out the same process in common. However, there may be a difference in the rotation speeds. In the case of the B-type, the rotor assembly 250 rotates in a regular or reverse direction, alternately. The A-, and C-type may also be designed to rotate the rotor assembly 250 in the regular or reverse direction, alternately.

However; in the case of the C type, the drain device 400 drains the water. Therefore, in the C type, the operation motor 450 is operated in the second step mode. Then, the second rod 412 moves in a state the braking on the drum 135 is released, to open the drain passage. Accordingly, the washing water can be drained from the outer tub 20.

In the C type operation of the washing machine, water is separated from the laundry by the centrifugal force, and drained to an outside of the washing machine through the drain device, fully.

Lastly, the case of the third mode when the agitating device and the inner tub 30 rotate in opposite directions is applicable to washing, and rinsing of the washing machine. In this case, a strong water circulation is formed in the inner tub 30, to improve washing, or rising performance.

In the third mode, the clutch assembly 300 disengages the lower spinning shaft 125 from the rotor assembly 250, and brake assembly releases braking on the drum 135.

For this, referring to FIG. 10A, the clutch motor 340 is operated to pull the clutch lever 320 slightly. Then, the clutching coupler 310 rises, to disengage the serration 254 on the rotor assembly 250 from the lower spinning shaft 125.

Above operation is similar to the first mode. However, what is unique in the third mode is that, different from the first mode in which the clutching coupler makes close contact to the stopper 360 when the clutching coupler 310 moves up, the clutching coupler 310 maintains a position spaced away from the stopper 360.

In this instance, the clutching coupler 310 and the stopper 360 are spaced approx. 1.about.10 nm, preferably as shown in FIGS. 10A.about.10B, approx. 3 mm. The clutching coupler 310 and the stopper 360 are spaced under the following reason.

In the third mode, the inner tub 30 rotates opposite to the agitating device. Therefore, though will be described later, even if rotation power of the rotor assembly 250 is not transmitted to the spinning shaft 120 directly by the clutching coupler 310, the spinning shaft 120 has the rotation power of the washing shaft 110 transmitted thereto indirectly by the gear device 130, and rotates. According to this, in the third mode, the clutching coupler 310 engaged with the lower spinning shaft 125 with the serration also rotates.

However, if the clutching coupler 310 has close contact with the stopper 360, even if the projections 315 and the recesses 365 are not provided to the clutching coupler 310 and the stopper 360, friction is occurred to cause wear of components, and noise.

Of course, the projections 315 and the recesses 365 are provided, leading to hold the spinning shaft 120, the third mode can not be made available. Therefore, in the third mode, the clutching coupler 310 and the stopper 360 maintain a state in which the clutching coupler 310 and the stopper 360 are spaced a distance away.

In the meantime, in the third mode, though the brake assembly 350 releases the braking on the drum 135 directly connected to the spinning shaft 120, the drain device 400 is not operated. Therefore, for this, the operation motor 450 operates in the first step mode.

Then, the brake lever 355 moves to move the brake pad 351 away from the outside circumferential surface of the drum 135, and the drain valve 410 moves, not the second rod 412, but the first rod 411 only. According to this, while the braking on the drum 135 is released, no washing water is drained.

Under above state, referring to FIG. 10C, if the rotor assembly 250 rotates in the clockwise direction, the lower washing shaft 115 and the sun gear 131 rotate in the clockwise direction, and the planet gears 133 rotate in the counter clockwise direction as well as revolve around the sun gear 31 in the clockwise direction.

In this instance, since the braking on the drum 135 has been released, the drum 135 rotates in the counter clockwise direction as a reaction to the revolution of the planet gear. According to this, the carrier 134 connected to the planet gears 133, and the drum 135 rotate in opposite directions, to rotate the agitating device and the inner tub 30 in opposite directions.

In the meantime, it will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As has been described, the washing machine of the present invention has a structure in which power is transmitted from the driving motor to the power transmission device, directly. According to this, a power transmission loss occurred in transmission of a driving power from the driving motor to the washing shaft is minimized to enhance an energy efficiency.

The coaxial rotation of the driving motor, the agitating means, and the inner tub prevent the inner tub and the outer tub from tilting even if the washing machine is used for a long time, thereby reducing out of order and lengthening a lifetime.

In the meantime, the direction connection of the outer rotor type BLDC motor to the power transmission device that rotates the agitating device and the inner tub permits to provide a washing machine with a lower height that is convenient for use of the user.

The curved incision in the outside circumferential surface of the rotor frame of the driving motor permits attachment of different sized permanent magnets to the same rotor frame, thereby providing interchangeability in production of motors of different outputs, and economy.

Moreover, the plurality of cooling blades at a side surface of the rotor frame permits to cool the driving motor effectively even if much heat is generated at the driving motor during spinning and the like, to improve reliability of the product.

Furthermore, the provision of the planetary gear device to the power transmission device for close connection of the washing shaft and the spinning shaft permits rotation of the agitating device and the inner tub in a variety of methods, to improve washing and rinsing capabilities.

In the meantime, the very simple structure of the clutch assembly that intermits power transmission between the power transmission device and the BLDC motor is not liable to cause malfunction, to improve product reliability.

Moreover, the control of the brake assembly that intermits rotation of the spinning shaft, and the drain valve by using one operation motor permits to a number of components, which is very economical.

What is claimed is:

1. A washing machine comprising:

an outer tub in a cabinet for holding washing water;

an inner tub rotatably mounted on an inside of the outer tub having an agitating device rotatably mounted therein;

a power transmission device having a washing shaft connected to the agitating device and a spinning shaft connected to the inner tub;

a driving motor on an outside of the outer tub having a rotor assembly with a magnetism, and a hollow stator assembly arranged in the rotor assembly, wherein the rotor assembly includes a rotor frame having the washing shaft connected to a lower central part directly and a plurality of permanent magnets attached to an inside circumferential surface of the rotor frame;

a clutch assembly for selective transmission of a driving power from the driving motor to the spinning shaft depending on operation modes; and a drain device for draining the washing water to an outside of the washing machine, wherein the rotor frame includes at least one first cooling blade formed at a part of a bottom surface of the rotor frame and a plurality of second cooling blades formed at a part of an outside circumferential surface of the rotor frame, wherein some of the plurality of second cooling blades are incised and bent in a rotation direction of the rotor frame, and the rest of the plurality of second cooling blades are incised and bent in an opposite direction of rotation of the rotor frame.

2. The washing machine as claimed in claim 1, wherein the first cooling blades is formed by a curved incising and bending toward an inside of the rotor frame.

3. The washing machine as claimed in claim 1, wherein the second cooling blades is formed by a curved incising and bending toward an inside of the rotor frame.

4. The washing machine as claimed in claim 3, wherein the second cooling blade is provided to a lower part of the rotor frame.

5. The washing machine as claimed in claim 3, wherein the second cooling blades are formed along a length direction of the rotor frame.

6. The washing machine as claimed in claim 1, wherein a number of the some of the second cooling blades differs from a number of the rest of the cooling blades.

7. The washing machine as claimed in claim 1, wherein a number of the incised and bent second cooling blades in a direction of rotation of the rotor frame in spinning is greater than a number of the incised and bent second cooling blades in a direction opposite to the rotation direction of the rotor frame.

8. The washing machine as claimed in claim 3, wherein the rotor frame includes a plurality of cooling blade sets each having a plurality of second cooling blades.

9. The washing machine as claimed in claim 8, wherein, of the plurality of second cooling blades in one of the cooling blade sets, some of the second cooling blades are incised and bent in a rotation direction of the rotor frame, and rest of the second cooling blades are incised and bent in an opposite direction of rotation of the rotor frame.

10. The washing machine as claimed in claim 9, wherein a number of the some of the second cooling blades differs from a number of the rest of the second cooling blades.

11. The washing machine as claimed in claim 8, wherein, of the plurality of second cooling blades in one of the cooling blade sets, a number of the incised and bent second cooling blades in a direction of rotation of the rotor frame in spinning is greater than a number of the incised and bent blades in a direction opposite to the rotation direction of the rotor frame.

* * * * *